US005611979A

United States Patent [19]

Hayashi et al.

[11] Patent Number: 5,611,979

[45] Date of Patent: Mar. 18, 1997

[54] FABRICATION METHOD FOR A FUNNEL LINER

[75] Inventors: Mitsutoshi Hayashi, Omiya; Mitsuo Ishitani, Sapporr, both of Japan

[73] Assignees: Tokyo Gas Co., Ltd., Tokyo; Nippon High Strength Concrete Co. Ltd., Hokkaido, both of Japan

[21] Appl. No.: 239,877

[22] Filed: May 9, 1994

[30] Foreign Application Priority Data

| | | | |
|---|---|---|---|
| May 11, 1993 | [JP] | Japan | 5-109495 |
| May 11, 1993 | [JP] | Japan | 5-109496 |
| Jul. 30, 1993 | [JP] | Japan | 5-190256 |
| Dec. 3, 1993 | [JP] | Japan | 5-303930 |
| Dec. 3, 1993 | [JP] | Japan | 5-303931 |

[51] Int. Cl.[6] ..... B28B 1/08; B28B 1/20

[52] U.S. Cl. ..... 264/71; 264/296; 264/297.9; 264/311

[58] Field of Search ..... 264/71, 311, 297.9, 264/296

[56] References Cited

U.S. PATENT DOCUMENTS

| | | | |
|---|---|---|---|
| 376,748 | 1/1888 | Meehan | 264/297.9 |
| 1,146,389 | 7/1915 | Aylsworth | 264/311 X |
| 1,326,902 | 1/1920 | Atterbury | 264/297.9 |
| 3,642,399 | 2/1972 | Barainsky et al. | 264/311 X |
| 3,741,707 | 6/1973 | Baumann et al. | 264/311 X |
| 4,102,624 | 7/1978 | Corona | 264/311 X |
| 4,217,124 | 8/1980 | Wyden | 264/311 X |
| 4,248,807 | 2/1981 | Gigante | 264/311 X |
| 4,294,793 | 10/1981 | Takazawa | 264/311 |
| 4,497,590 | 2/1985 | Chase . | |
| 4,504,428 | 3/1985 | Rotondo et al. | 264/311 X |
| 4,517,139 | 5/1985 | Rawlings et al. | 264/311 X |
| 4,568,501 | 2/1986 | Wichterle et al. | 264/311 X |
| 4,662,773 | 5/1987 | Baumann et al. . | |
| 5,082,614 | 1/1992 | Hartmann et al. | 264/311 X |

FOREIGN PATENT DOCUMENTS

| | | | |
|---|---|---|---|
| 2526856 | 11/1983 | France . | |
| 531260 | 8/1971 | Germany . | |
| 3213537 | 10/1983 | Germany | 264/297.9 |
| 1021952 | 1/1986 | Japan | 264/311 |
| 1021950 | 1/1986 | Japan | 264/311 |
| 0041203 | 2/1990 | Japan | 264/311 |
| 4059306 | 2/1992 | Japan | 264/311 |
| 4039003 | 2/1992 | Japan | 264/311 |
| 4107102 | 4/1992 | Japan | 264/311 |
| 4319407 | 11/1992 | Japan | 264/311 |
| 230874 | 4/1944 | Switzerland . | |
| 1348765 | 3/1974 | United Kingdom . | |
| 1408642 | 10/1975 | United Kingdom . | |

*Primary Examiner*—Karen Aftergut
*Attorney, Agent, or Firm*—Oliff & Berridge

[57] ABSTRACT

A tunnel liner used for a shield tunneling method for a tunnel having a diameter of 1.5 to 7 m is fabricated by dividing a ring-shaped liner into a plurality of parts in the circumferential direction. The tunnel liner is required to be excellent in the dimensional accuracy with respect to the outer peripheral surface, to be tight, to be high in strength, and to be high in water tightness at the abutment between the adjacent liners. The tunnel liner is fabricated by a method of filling each arcuate enclosed hollow form with concrete, vibro-compacting concrete, molding the end surfaces of the tunnel liner, mounting the forms within a centrifugal molding drum, and tightly molding the outer peripheral surface of the forms by applying of a centrifugal force. According to this fabrication method, it is possible to effectively fabricate an excellent tunnel liner at a low cost.

5 Claims, 35 Drawing Sheets

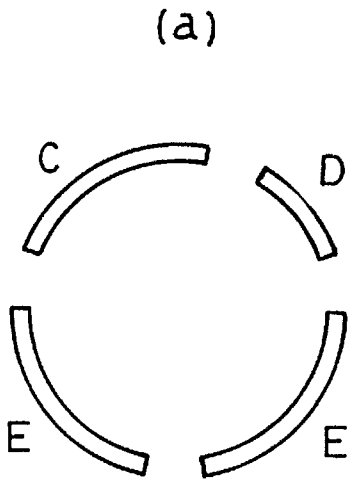
Fig.17(a)
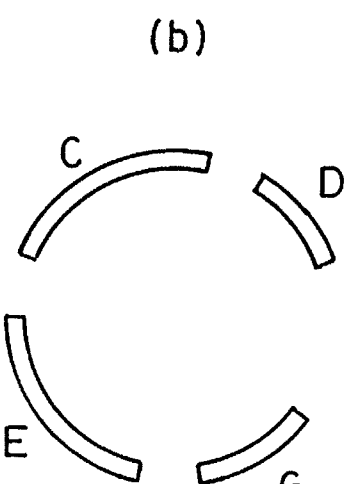
Fig.17(b)
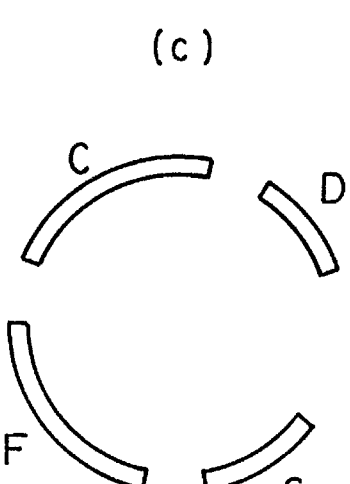
Fig.17(c)
Fig.17(d)
Fig.17(e)

FABRICATION METHOD FOR A FUNNEL LINER

BACKGROUND OF THE INVENTION

1. Field of the Invention

The present invention relates to a concrete tunnel liner used for a shield tunneling method for a tunnel having a diameter of about 1.5 to 7.0 m; its fabrication method; and its fabrication apparatus.

2. Description of the Related Art

A tunnel liner laid around the inner surface of a tunnel having a diameter of several meters has been generally fabricated using concrete segments, concrete blocks and the like.

The tunnel liner used for a shield tunneling method requires the function that the outer surface is tightly contacted with a shield machine for preventing permeation of water.

Namely, the outer peripheral surface must be excellent in dimensional accuracy, high in water tightness, and smooth in surface finish. Such a tunnel liner is fabricated to be divided into arcuate plates, and is assembled in a cylindrical shape at a job site. Accordingly, the abutment portion between adjacent liners must be high in water tightness. To increase the water tightness, the abutment surfaces of the tunnel liners are provided with projections and grooves engaged with each other.

The arcuate plate-like concrete tunnel liner has been conventionally fabricated by a method of mounting reinforcing steelbar or coupler in a form which is stationary such that the outer peripheral surface of the tunnel liner becomes the upper surface of concrete, placing concrete in the form compacting concrete using a vibrator. The concrete liner thus fabricated has been manually finished in its upper surface of concrete.

On the other hand, there has been known a fabrication method of forming forms within a centrifugal molding drum having an inside diameter equal to the outside diameter of a tunnel liner, placing concrete in the drum, thereby centrifugally molding arcuate plate-like tunnel liners.

The tunnel liner fabricated by centrifugal molding has excellent characteristics of being compact in concrete at the outside diameter portion, high in dimensional accuracy, smooth in the surface, and superior in water tightness. However, the abutment portion between the adjacent tunnel liners has not been perfect.

Namely, in fabrication of an arcuate plate-like tunnel liner, the projections or recessed grooves provided on the surfaces of the peripheral edge of the tunnel liner are not accurately formed, and honeycomb surface is generated on the concrete surface. Moreover, micro-gaps are generated due to the inertia force of the rotation at the abutment surface of concrete with the inner surface of the form on the downstream side of the rotational direction of the centrifugal molding drum, which brings about a problem in causing the water-path on the concrete surface. The end surfaces of the peripheral edges of the liner abutting on the inner surface of the form becomes the coupling surface with the adjacent concrete liner, which are generally formed in a projection-groove engaging connection. In the worst case, there is a fear that the projection-groove engaging connection portions are broken, and the water-tightness as the most important factor of the concrete liner is lost.

The present inventors have studied a technique of dividing a tunnel liner into arcuate parts having a suitable size and centrifugally molding the divided liners particularly to enhance the water-tightness of the above abutment surface, and further of effectively fabricating a high quality tunnel liner, particularly being excellent in accuracy in the outer peripheral surface and the adjacent surface.

SUMMARY OF THE INVENTION

An object of the present, invention is to provide a tunnel liner suitable for a shield tunneling method, which has an outer peripheral surface being accurately circular and extremely smooth, and which possesses a high strength.

Another object of the present invention is to provide a method of effectively and easily fabricating a tunnel liner having an excellent quality.

A further object of the present invention is to provide a method of constructing a tunnel liner in which a prestress is introduced in the circumferential direction, and an apparatus used for the construction.

Still further object of the present invention is to provide a method allocating divided liners in a centrifugal molding drum in fabrication of an arcuate plate like tunnel liner.

A specific object of the present invention is to form a recessed or projecting portion having high dimensional accuracy and tight shape on the surfaces of a peripheral edge of each centrifugal concrete liner, and particularly to form a tight concrete with a high quality for preventing the generation of the water-path on the abutment portion of the inner surface of a form on the downstream side in the rotational direction of an arcuate centrifugal molding concrete liner.

Another specific object of the present invention is to provide a technique of fabricating a tunnel liner having a large outside diameter using a centrifugal molding drum having a diameter smaller than the outside diameter of the tunnel liner to be fabricated.

A further specific object of the present invention is to provide an apparatus of mounting/dismounting centrifugal molding forms in a centrifugal molding drum for concrete liners, which includes a simple and certain form holding apparatus.

Still a further specific object of the present invention is to provide an auxiliary driving unit used for mounting and dismounting forms into and from a centrifugal molding drum.

An additional object of the present invention is to provide a technique of easily centrifugally molding a tunnel liner having a diameter larger than that of the conventional one.

To achieve the above object, the technical means of the present invention is as follows.

A tunnel liner of the present invention includes a ring-shaped connected body composed of straight liners each having a-rectangular shape in the circumferential development and taper liners each having a trapezoidal shape.

The above tunnel liner preferably includes two straight liners each having a center angle of 90°, two single taper liners each having an average center angle of (90–$\alpha$), and one double taper liner having an average center angle of 2 $\alpha$. This makes it possible to facilitate the standardization, to simplify the lying within the tunnel, and to facilitate the fabrication. In addition, the average center angle is an arithmetic average of the center angles corresponding to the upper and lower sides of the trapezoidal shape in the development of the tunnel liner. Moreover, $\alpha$ is an arbitrary angle less than 90°, and is preferably selected to about 10°.

In the tunnel liner of the present invention, the projection-groove engaging connection is preferably used to obtain the circumferential integral coupling and ring-to-ring integral coupling, and to enhance the water-cutoff effect.

The abutment portion between the adjacent liners is provided with a seat on which a band-like sealing material for separating the inner periphery from the outer periphery of the liner is seated, and a crimping means for pressing the sealing material. This makes it possible to ensure the excellent water-tightness.

According to the present invention, there is provided a method of constructing a prestressed concrete tunnel liner including the steps of: burying an unbonded PC steel material (a steel wire(s) or bar(s) for prestressed concrete) in each arcuate liner along the circumferential direction, and providing openings from which the end portions of the unbonded PC steel material are exposed on the inner surface of the liner; assembling the liners in a cylindrical shape; coupling the PC steel materials in a ring shape; and stretching the PC steel materials for introducing a prestress in the tunnel liner in the circumferential direction.

An apparatus of the present invention suitable for execution of the above method, includes (a) a sawtooth sleeve composed of radially extensible elastic material, which is externally inserted around the end portion of an unbonded PC steel material, (b) a cylindrical coupler having inner sawtooth portions meshing with the outer sawtooth portions on both sides, (c) A jack device locked onto the sleeves for pulling both the sides of the PC steel materials to each other and fixing the sleeves within the coupler.

The present invention provides a method of fabricating a tunnel liner including of: dividing one circumference of the tunnel liner into liners of n-pieces each having an arbitrary arc length, and preparing the combination of n-kinds of forms of (n−1) pieces; and allocating the combination of n-kinds of the forms in a centrifugal molding form drum, thereby centrifugally molding the liners.

The present invention provides a method of fabricating a centrifugal molding concrete liner including the steps of: holding an arcuate enclosed hollow form in a posture that one end of an arcuate side plate is high and the other end thereof is low; filling the form with concrete from the upper side; accelerating the flowing-down filling of concrete and vibro-compacting concrete by applying of vibration; mounting the thus prepared forms in a centrifugal molding drum, and consolidating concrete by applying a centrifugal force; removing the forms from the centrifugal molding drum, and also removing a forming panel each on an arcuate inner surface side of the form for finishing the arcuate inner surface side of concrete; and performing concrete curing.

The present invention provides an apparatus for fabricating a centrifugal molding concrete liner including: a centrifugal molding drum; and a plurality of individual liner forms each having a hollow arcuate shape, which are removably fixed within the drum; wherein each of the individual liner forms is an enclosed form including an arcuate outer surface plate, an arcuate inner surface plate, two rectangular side plates and two arcuate side plates; the arcuate inner surface plate is provided with a frame-like parting surface having a specified height around the inner surface of the form; and an enclosable concrete charge port is provided near one rectangular side plate, and an air vent hole is provided near the other rectangular side plate.

A method of fabricating a centrifugal molding concrete liner of the present invention includes the step of reversing the rotational direction of a centrifugal molding drum.

According to the present invention, there is provided a method of fabricating a centrifugal molding tunnel liner including the steps of: mounting forms of individual liners divided in an arcuate shape within a centrifugal molding drum having a diameter smaller than the outside diameter of a tunnel liner to be fabricated; placing concrete within the forms for centrifugal molding; compacting concrete centrifugally and removing the forms from the centrifugal molding drum; and removing an excessive thickness of the placed concrete on the inside diameter side of the individual liners.

The basic thought of the present invention is to give a sufficient rigidity to each form and to mount it within a centrifugal molding drum. Namely, according to the present invention, there is provided a form for fabricating a centrifugal molding tunnel liner including an arcuate bottom plate provided on the back surface with ribs for providing a rigidity to the bottom plate; wherein the form is independently formed, and a plurality of the forms are disposed on the inner surface of a centrifugal molding drum.

The present invention provides an apparatus of mounting/dismounting molding forms for concrete liners in a centrifugal molding drum including: projections provided on the outer surfaces of both end portions of an arcuate concrete liner form mounted within a centrifugal molding drum; L-shaped hooks engaged with the projections for holding the form on the inner wall of the drum, which is provided while passing through the wall of the drum; and a rod mechanism for engaging and disengaging the L-shaped hooks with and from the projections, which is provided outside the drum.

According to the present invention, there is provided an apparatus for centrifugally molding concrete liner including: a driven side meshing transmission unit mounted on the outside diameter of a centrifugal molding drum for concrete liners; and an auxiliary driving unit for low speed rotation which includes a drive side transmission unit meshing with the driven side transmission unit; wherein the auxiliary driving unit is disposed to be movable forward and rearward to the centrifugal molding drum.

The present invention provides a method for fabricating tunnel liners including the steps of: removably mounting individual enclosed hollow forms for a plurality of arcuate liners within a centrifugal molding drum rotating around the vertical center axis; and centrifugally molding the liners.

According to the present invention, there is provided a composite tunnel liner including: a steel box or FRP (fiber-reinforced plastic) box formed of a plurality of arcuate bottom plates and side walls erected around four peripheries of each bottom plate, whereby the box is filled with concrete.

BRIEF DESCRIPTION OF THE DRAWINGS

FIG. 17(*a*) to 17(*e*) are typical views showing the allocation of the embodiment;

FIG. 21(*b*) is a side view; and FIG. 21(*c*) is a front view;

FIG.36(*b*) is a vertical sectional view.

DESCRIPTION OF THE PREFERRED EMBODIMENTS

The tunnel liner of the present invention is divided into parts to be easily fabricated by centrifugal molding and to be easily assembled upon construction. Namely, the tunnel liner includes a ring-like coupling body of straight liners each having a rectangular shape in the circumferential development, and taper liners having respective trapezoidal shapes in the development. For example, it includes two straight liners each having a center angle of 90°, two single taper liners each having an average center angle of about 80°, and a double taper liner having an average angle of about 20°.

Figure 1B:
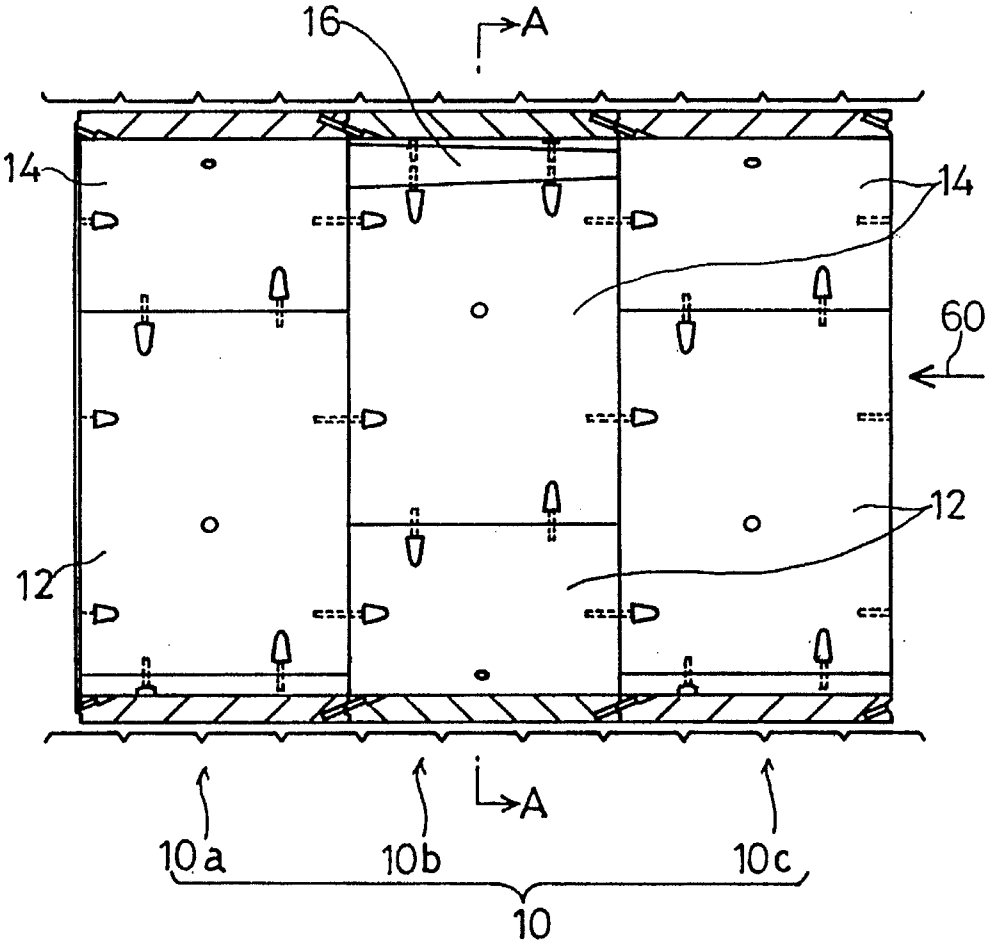
FIGS. 1(*a*) and 1(*b*) are views of a tunnel liner of an embodiment wherein FIG. 1(*a*) is a transverse sectional view and FIG. 1(*b*) is a vertical sectional view.
Figure 1A:
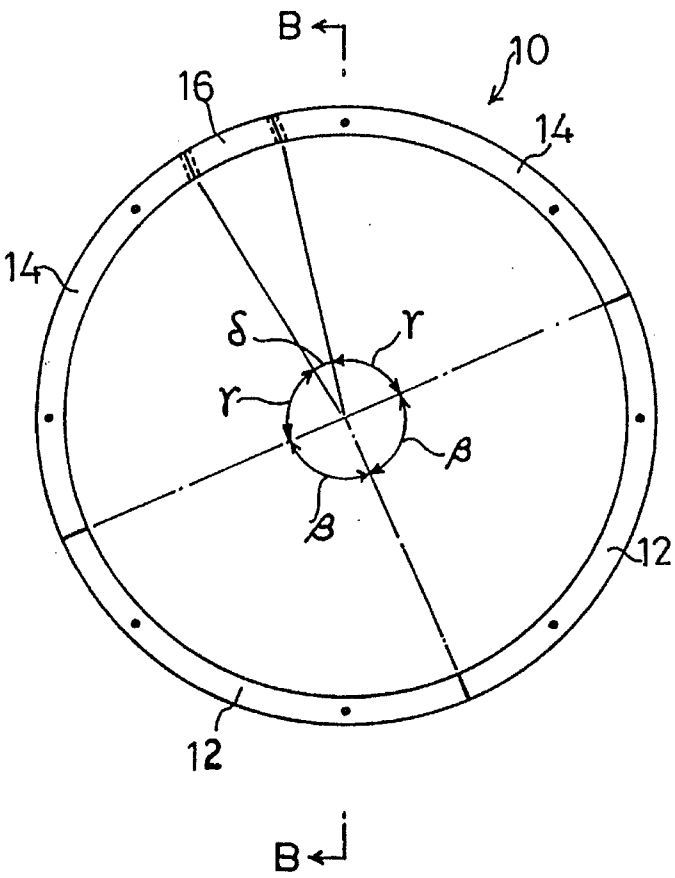

FIGS. 1(*a*) and 1(*b*) show a tunnel liner 10 according to an embodiment of the present invention, wherein FIG. 1(*a*) is a view taken along the line A—A of FIG. 1(*b*), and FIG. 1(*b*) is a view taken along the line B—B of FIG. 1(*a*). As shown in FIG. 1(*a*), the tunnel liner 10 of this embodiment is a ring-like coupling body of straight liners 12 and 12 each having a center angle $\beta$ of 90°, single taper liners 14 and 14 each having an average center angle $\gamma$ of 80.235°, and a double taper liner 16 having an average center angle $\delta$ of 19.323°. This tunnel liner has an inside diameter of 2,500 mm $\phi$, outside diameter of 2,750 mm $\phi$, thickness of 125 mm, and longitudinal length of 1,200 mm. FIG. 1(*b*) shows a cylindrical tunnel lining in which these rings 10*a*, 10*b* and 10*c* are coupled with each other, and which is adapted to be advanced in the direction of the arrow 60.

Figure 2:
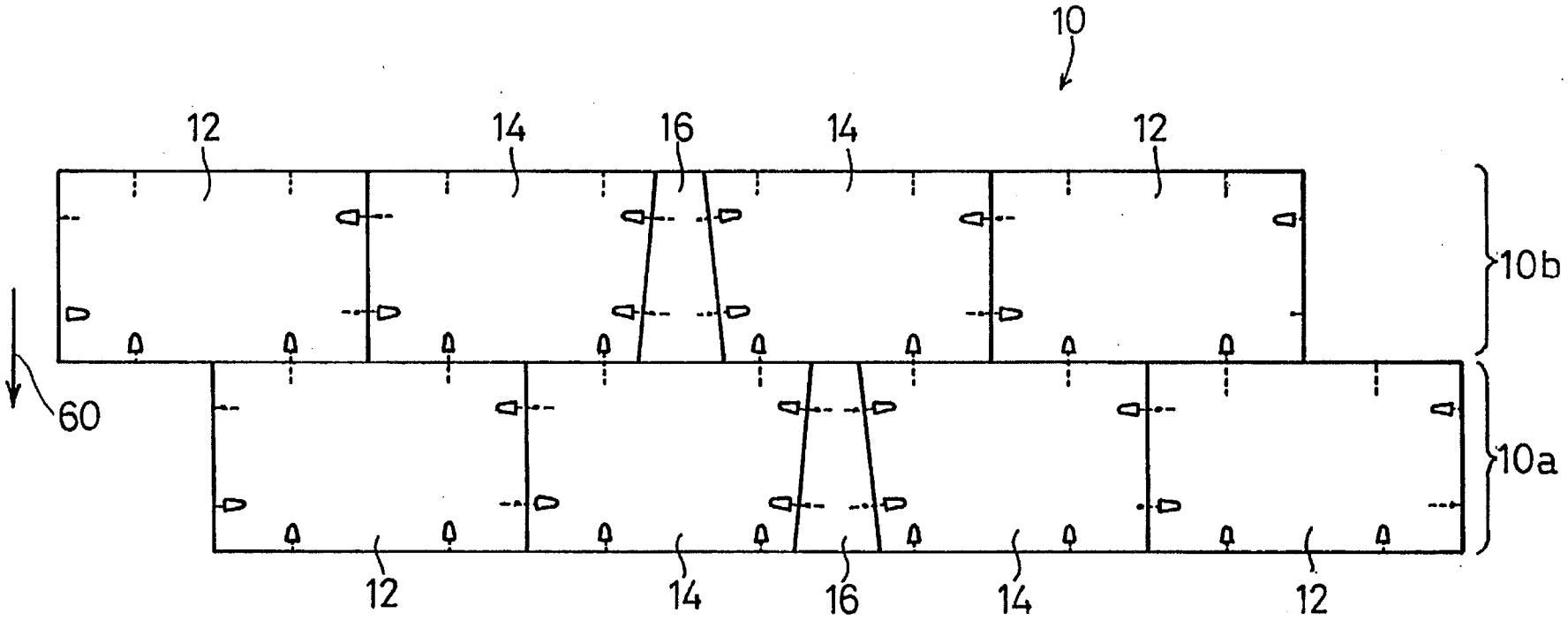
FIG. 2 is a development of the tunnel liner of the embodiment.

FIG. 2 illustrates the development of the inner surfaces of these rings 10*a* and 10*b*. In these development, the straight liner 12 has a size of 1200 mm (width)×1963.5 mm (length); the single taper liner 14 has a size of 1200 mm (width)× 1852.5 mm (long side)×1652.5 mm (short side); and the double taper liner 16 has a size of 1200 mm (width)×622.0 mm (long side)×222.0 mm (short side). In FIG. 2, the arrow 60 indicates the advancing direction.

Figure 3A:
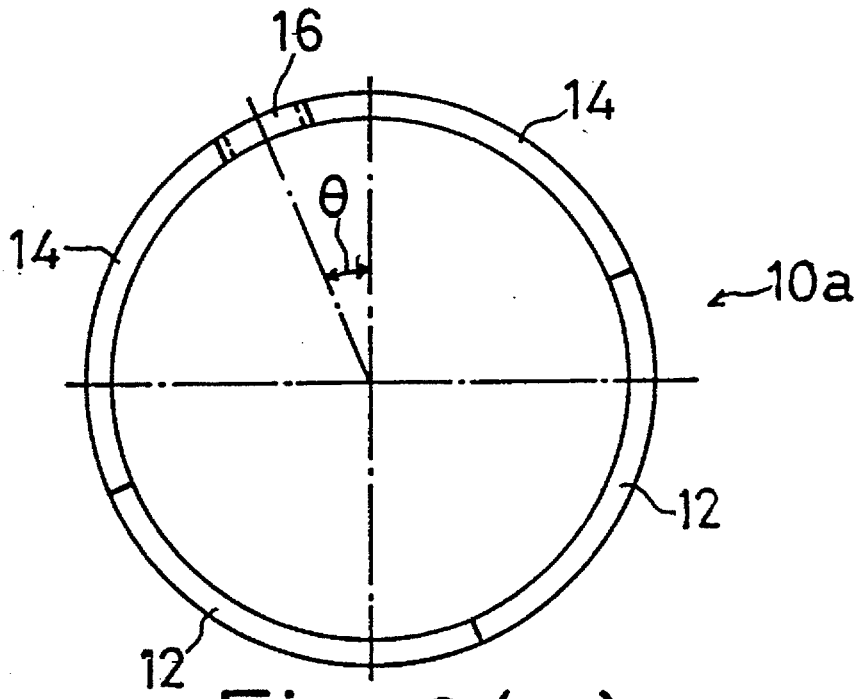
FIGS. 3(*a*) and 3(*b*) are front views of the tunnel liner of the embodiment.
Figure 3B:
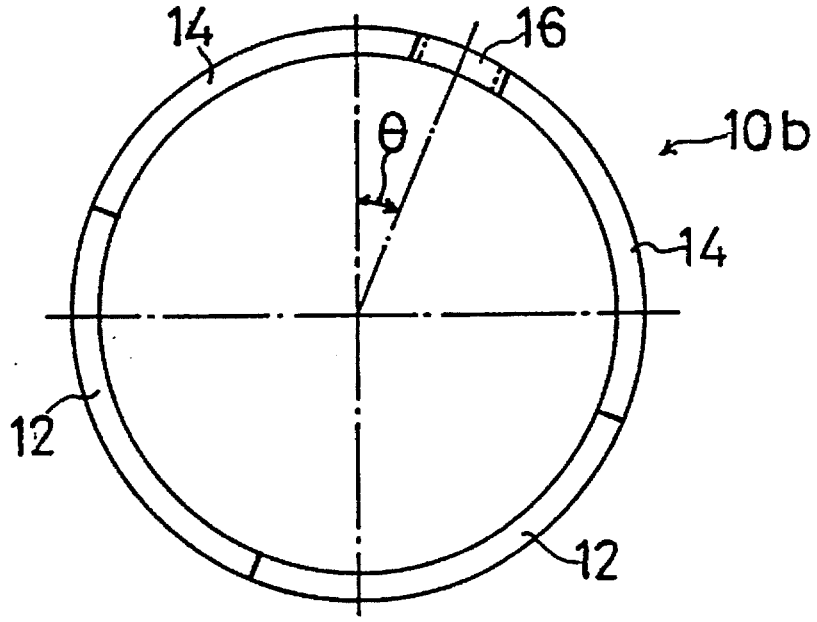
Figure 4A:
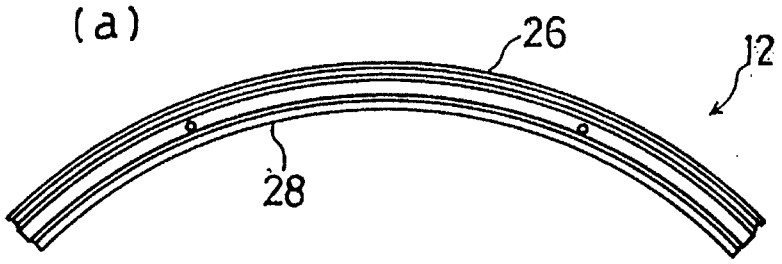
FIGS. 4(*a*) to 4(*d*) are views for explaining a straight liner of the embodiment.
Figure 4B:
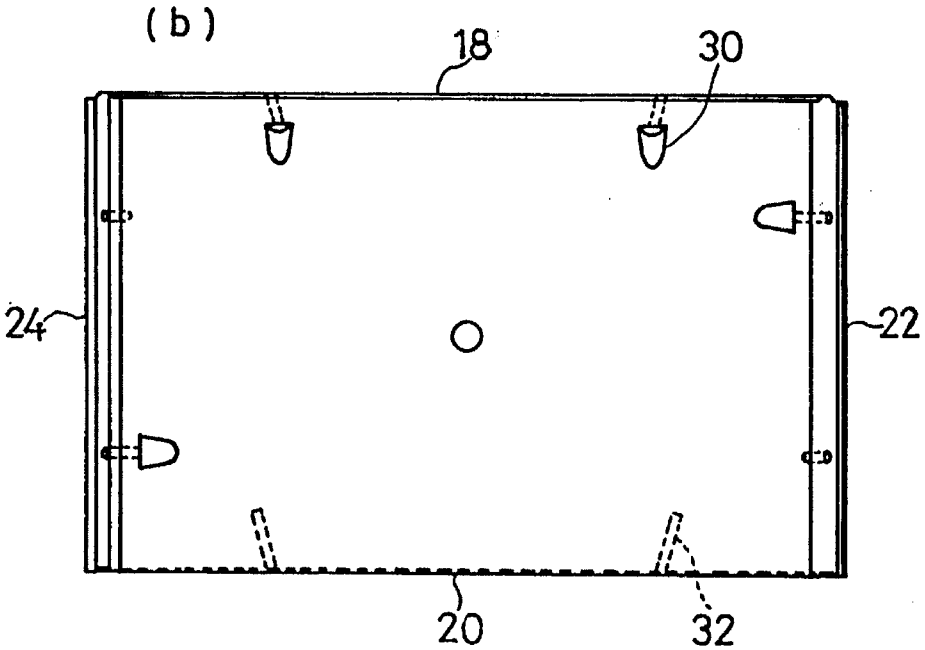
Figure 4C:
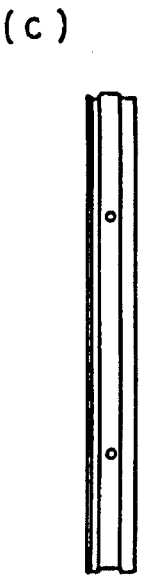
Figure 4D:
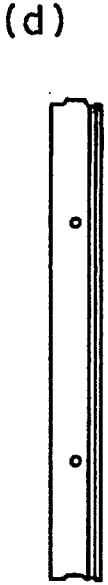

FIG. 3(*a*) shows the ring 10*a* as seen from the backside of the advancing direction (arrow 60) of FIGS. 1(*a*) and 1(*b*); and FIG. 3(*b*) shows the ring 10*b* subsequent to the ring 10*a* as seen from the same direction. The double taper liners 16 and 16 are respectively disposed in the rings 10*a* and 10*b* so as to be symmetric and tilted by a center angle $\theta$=22.5° with respect to the vertical axis.

FIG. 4 shows the detail of the straight liner 12, wherein 4(*a*) shows the end surface of the ring, 4(*b*) shows the inner surface, 4(*c*) shows the left end surface, and 4(*d*) shows the right end surface. Peripheral edge side surfaces 18, 20, 22 and 24 are provided with projections or recesses to be coupled with the adjacent liner in a projection-groove engaging connection manner. Moreover, the straight liner 12 is provided with notches 30 into which connecting bolts are inserted, and inserts 32 into which connecting bolts are screwed.

In the tunnel liner of the present invention, the projection-groove engaging connection is used as the circumferential coupling and the ring-to-ring coupling, so that the adjacent liners can be easily engaged with each other. The structure using the projection-groove engaging connection is also effective to cut off water. Additionally, the peripheral edge side portion of the liner, that is, the abutment portion with the adjacent liner is provided with a seat, on which a band-like sealing material for separating the inner periphery from the outer periphery of the liner is seated. Thus, by interposing a sealing material into the seat portion, and pressing and bonding the sealing material thereon by means of a coupling bolt, it is possible to ensure the further excellent water tightness.

Figure 5:
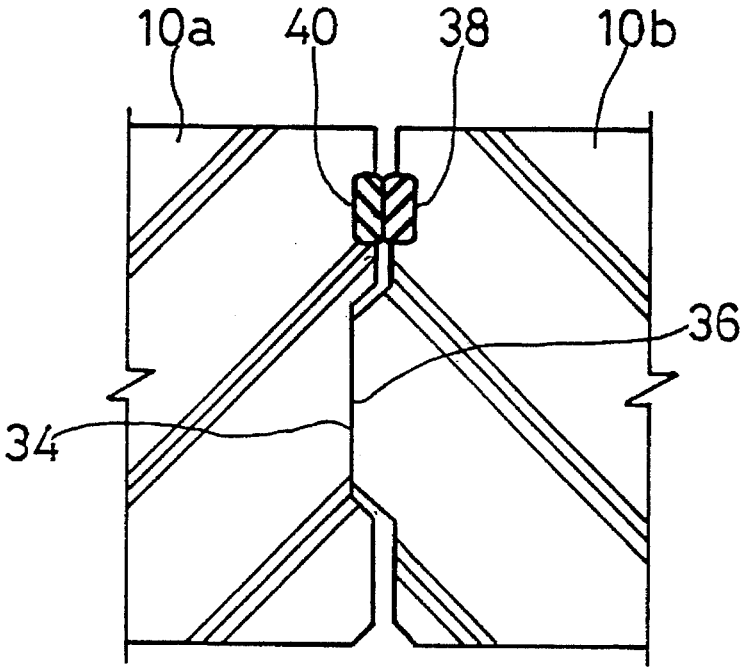
FIG. 5 is a partial sectional view showing the structure of an abutment portion between the rings of the tunnel liner of the embodiment.
Figure 6:
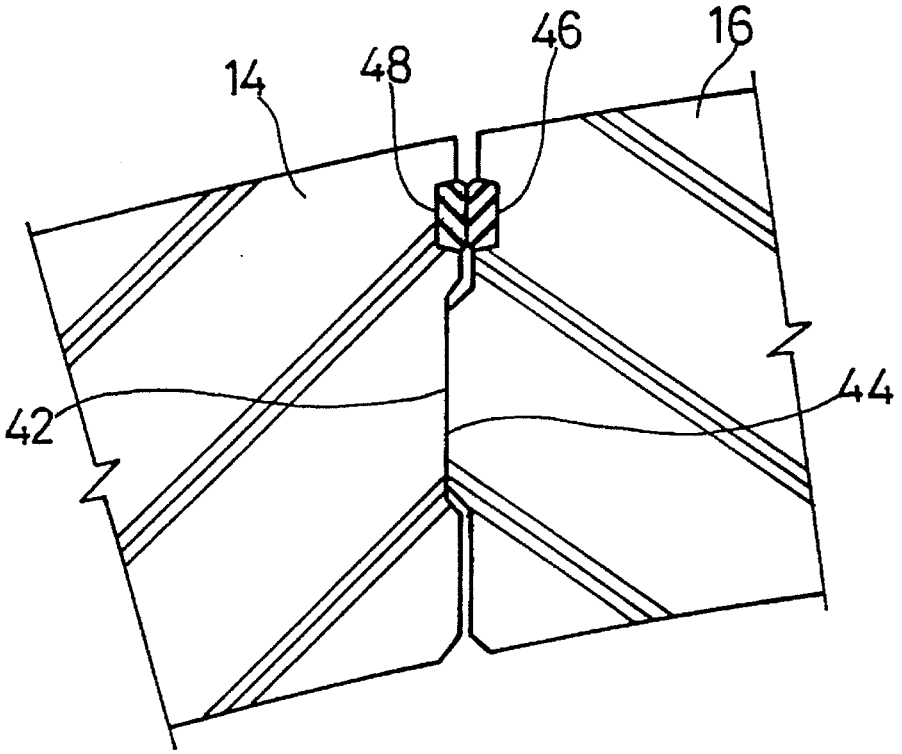
FIG. 6 is a partial sectional view showing the circumferential coupling portion of the tunnel liner of the embodiment.
Figure 7:
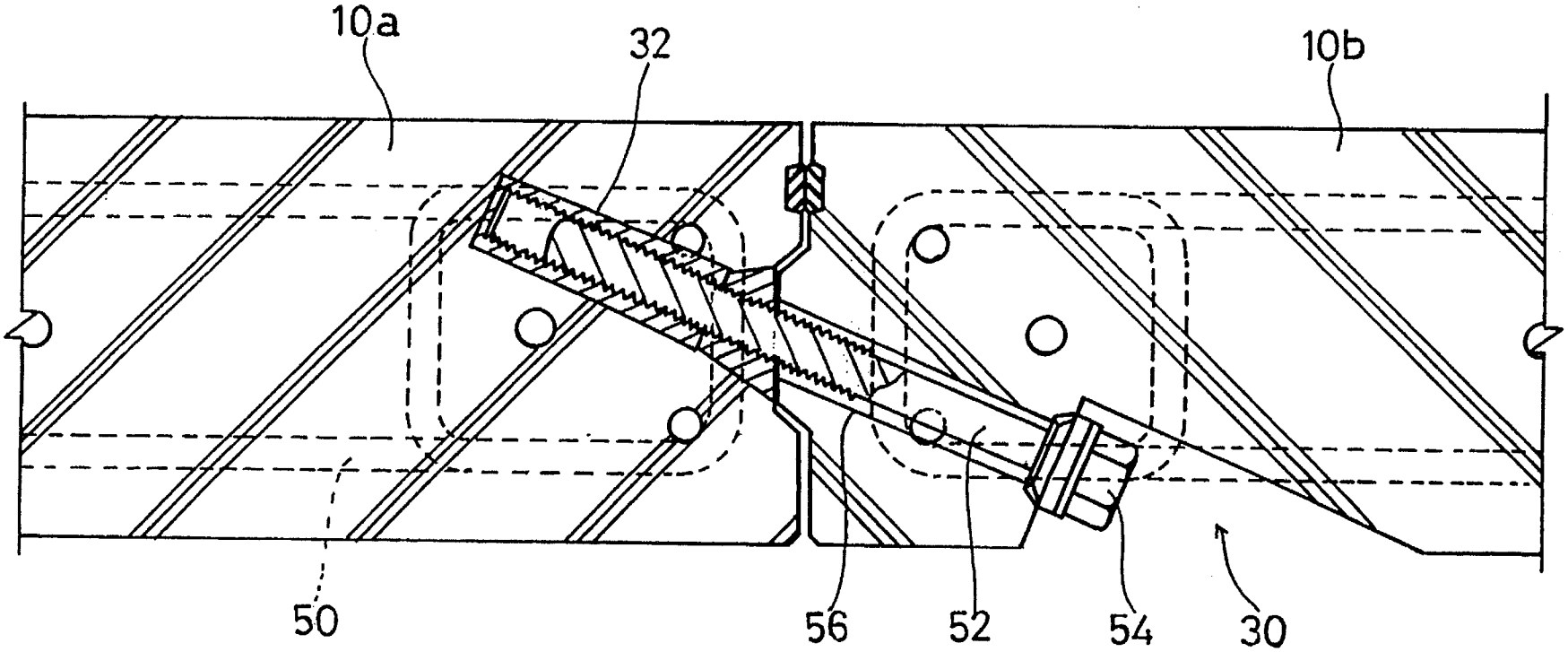
FIG. 7 is a partial sectional view showing the structure of the abutment portion between the rings of the tunnel liner of the embodiment.
Figure 8:
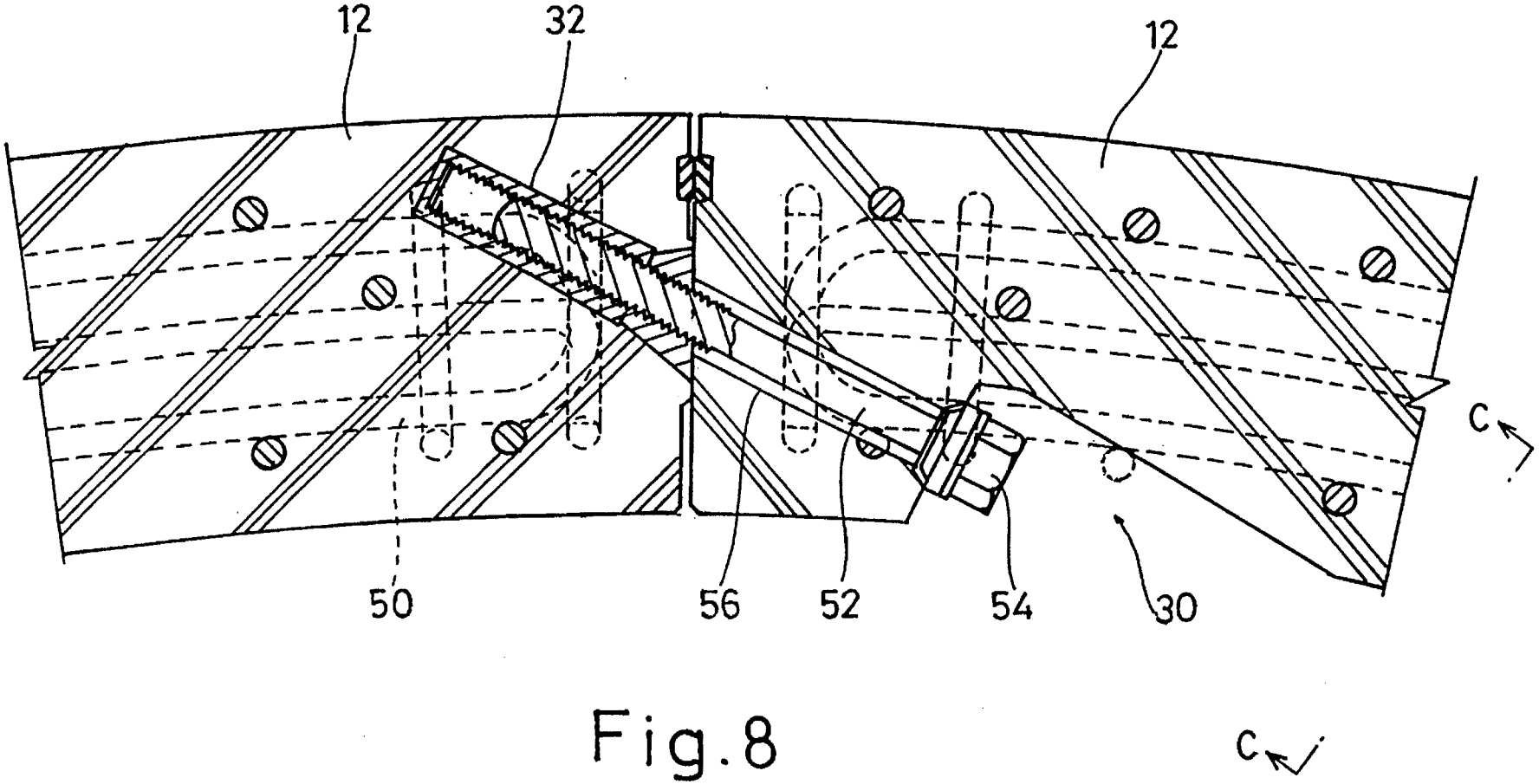
FIG. 8 is a partial sectional view showing the circumferential coupling portion of the straight liner of the embodiment.
Figure 9:
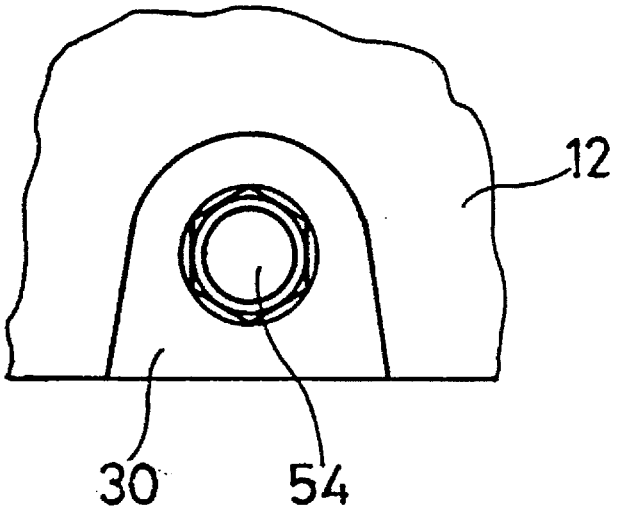
FIG. 9 is a view taken along the line C—C of FIG. 8.
Figure 10:
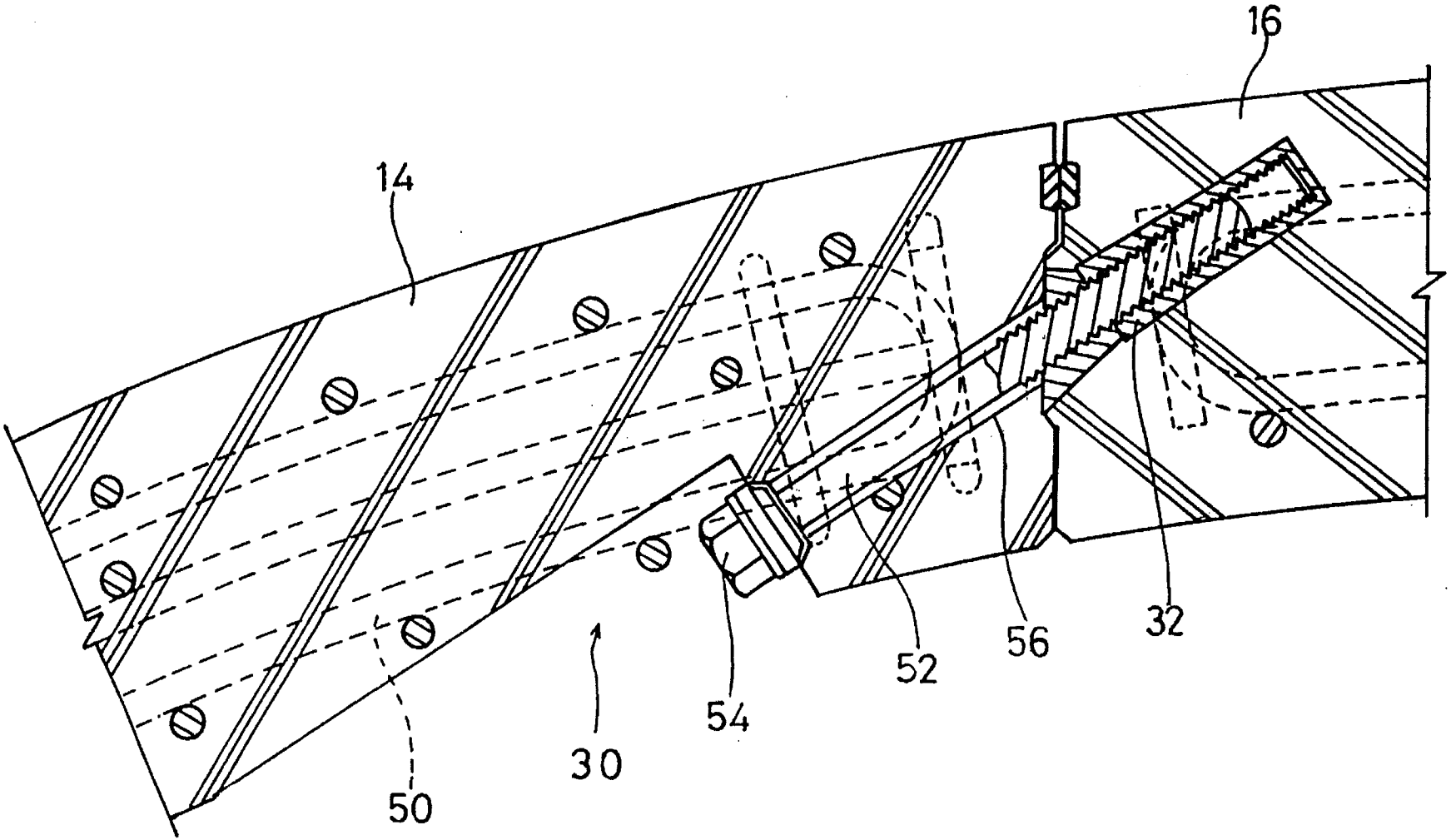
FIG. 10 is a view showing the coupling portion between a single taper liner and a double taper liner shown in FIG. 8.

FIG. 5 shows the structure of an abutment portion between the rings 10*a* and 10*b*. A recessed portion 34 and a projecting portion 36 are formed to be opposed to each other, so that the rings 10*a* and 10*b* are easily coupled in a projection-groove engaging connection manner. Moreover, each of the rings 10*a* and 10*b* is formed with a seat 40 on which a rubber packing 38 as a sealing member is seated. FIG. 6 shows the structure of a circumferential coupling portion between the single taper liner 14 and the double taper liner In this figure, numeral 42 and 44 indicates a recessed portion and a projecting portion for a projection-groove engaging connection; 46 is a rubber packing; and 48 is a seat. FIG. 7 shows a coupling member between the ring 10*a* and 10*b*. A coupling bolt 52 is screwed and fixed into the insert 32 fixed on a reinforcing steel bar 50. Numeral 54 indicates a head portion of the coupling bolt, and 56 is a sheath. The notch 30 and the sheath 56 for mounting the coupling bolt are previously provided. FIG. 8 shows a coupling portion between the straight liners 12 and 12; FIG. 9 is a view taken along the line C—C of FIG. 8; and FIG. 10 shows a coupling portion between the single taper liner 14 and the double taper liner 16. In these figures, same parts are indicated at the same numerals.

Figure 11:
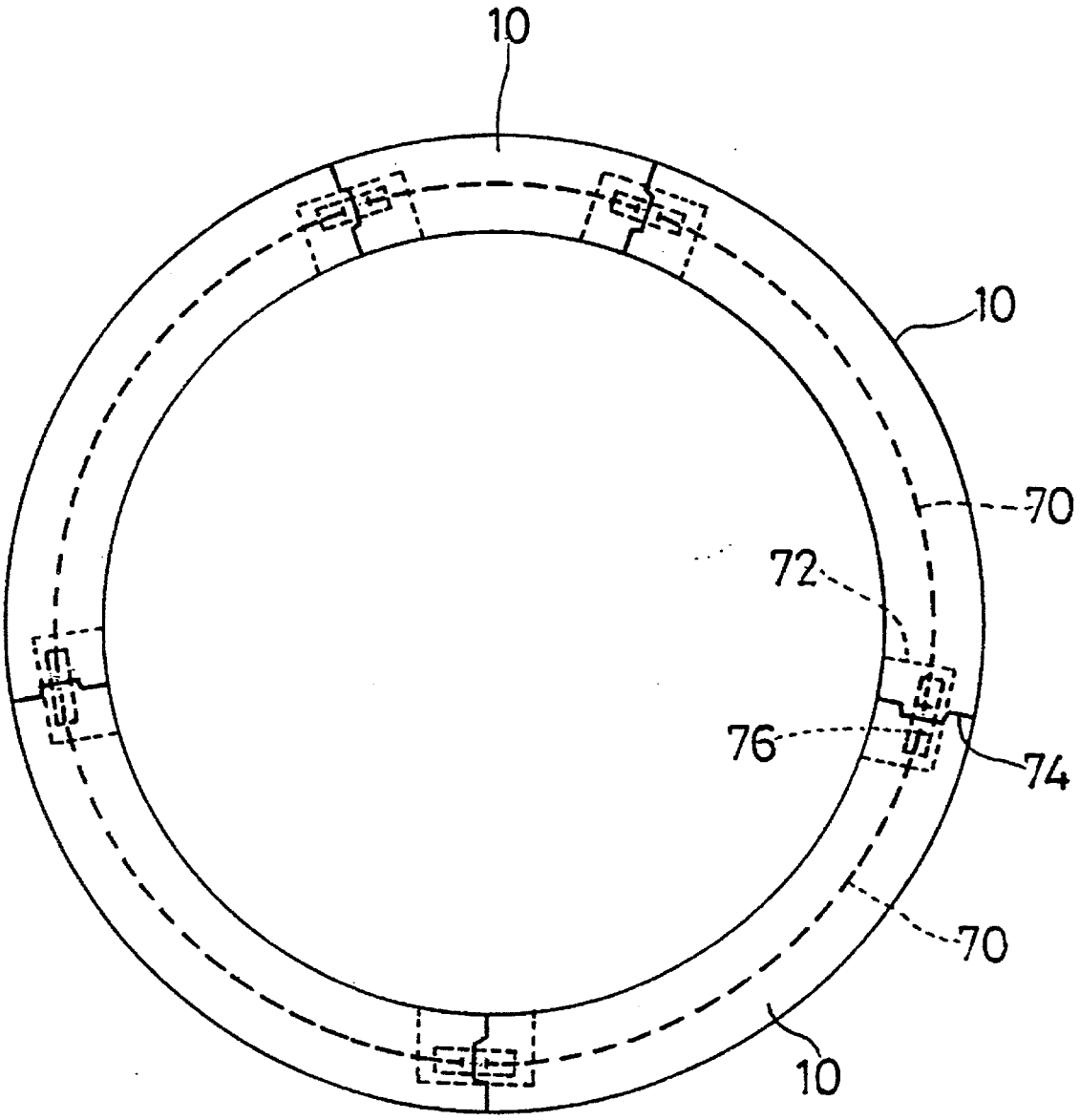
FIG. 11 is a front view showing the structure of the tunnel liner of the embodiment.

FIG. 11 shows a tunnel liner wherein a plurality of liners are assembled in a ring-shape while introducing a prestress thereto. A PC steel material 70 is composed of an unbonded PC steel material buried in each liner 10 upon concrete placing.

The unbonded PC steel material is subjected to a surface treatment for preventing the sticking with concrete. For example, the outer surface is covered with a synthetic resin sheath, paper or the like; or it is coated with lubricant. The examples of the PC steel materials of the present invention include a PC steel bar and a PC strand.

The dimensions and arrangement of the PC steel bars are designed according to the specification of a tunnel liner and the condition of a location to be buried, and they not limited. However, for a tunnel liner having an outside diameter of 2 to 3 m and a longitudinal dimension of about 1 to 1.5 m, one or two of the PC steel bars or strands are generally provided in combination with the reinforcing steel framework.

Figure 12:
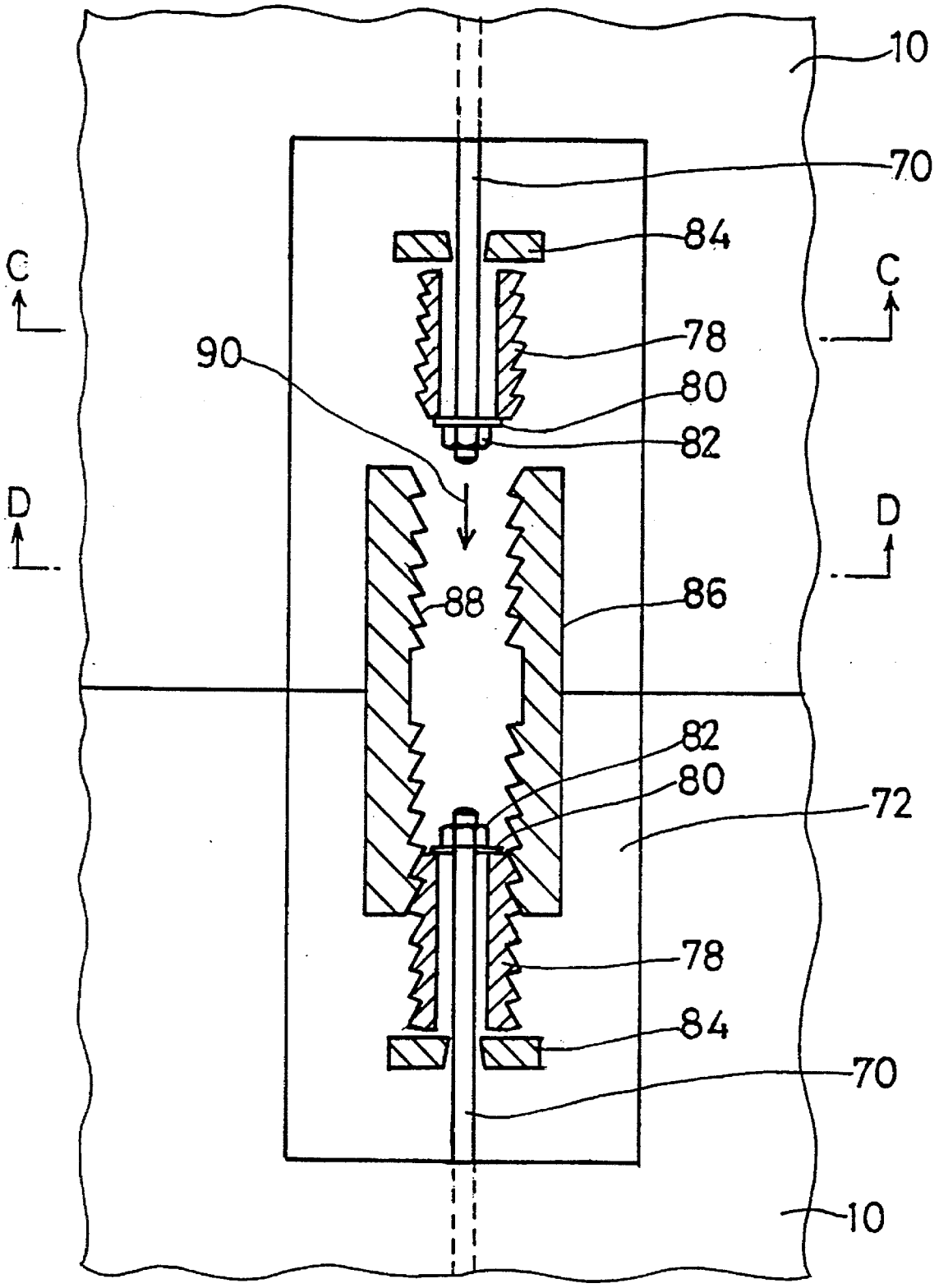
FIG. 12 is a view for explaining the structure of the end portion of the PC steel material of the embodiment.

As shown in FIG. 11, the end portions of the PC steel materials inside connecting end surfaces 72 of the adjacent liners 10 are coupled with each other by each coupler 76 within openings 72 opened to the insides of the liners. One of the openings 72 is used for introducing a prestress to the coupled PC steel materials. Namely, the PC steel materials are jointed in a ring shape, and are stretched to introduce a circumferential prestress to the tunnel liner. FIG. 12 shows the opening 72 for introducing a prestress as seen from the inner side of the liner. The end portion of the unbonded PC steel material 70 exposed within the opening 72 and the fixing coupler are shown in vertical section.

Figure 13:
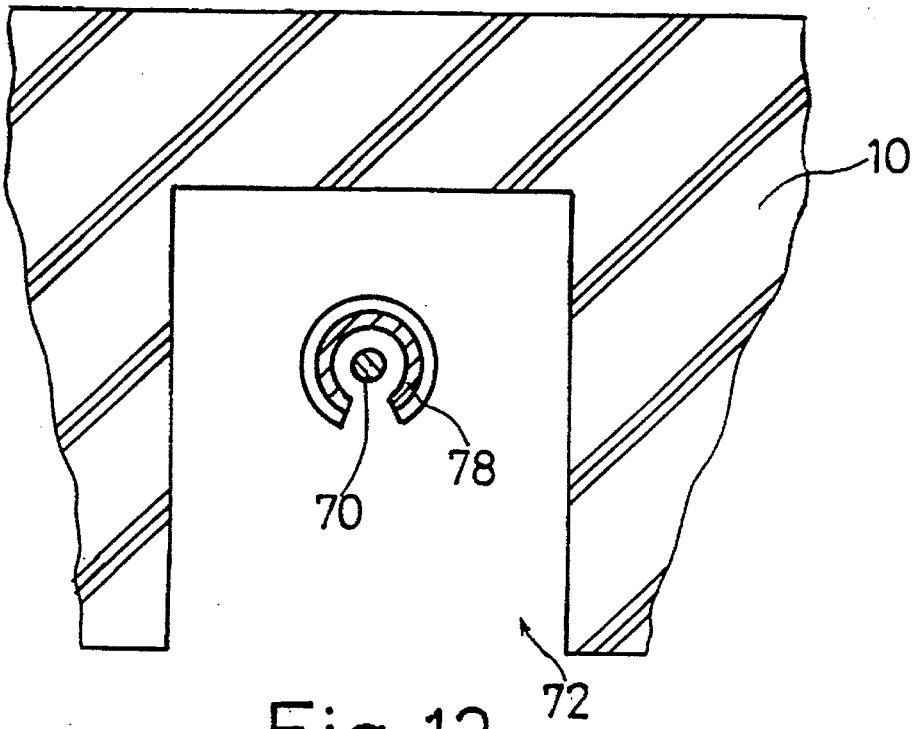
FIG. 13 is a view taken along the line C—C in FIG. 12.
Figure 14:
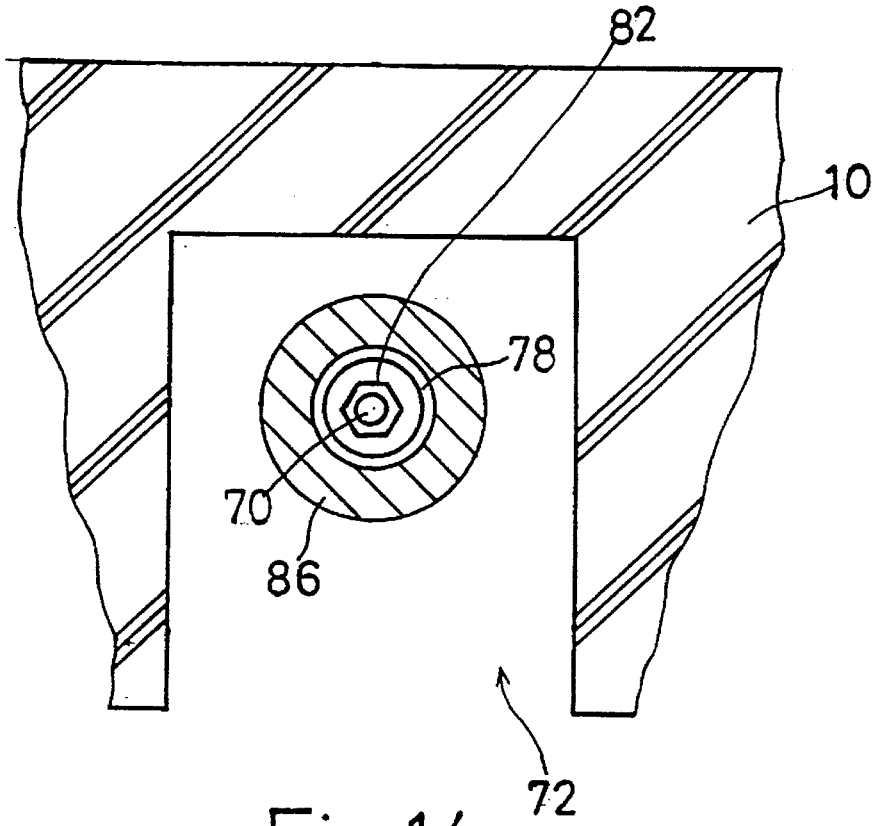
FIG. 14 is a view taken along the line D—D of FIG. 12.
Figure 15:
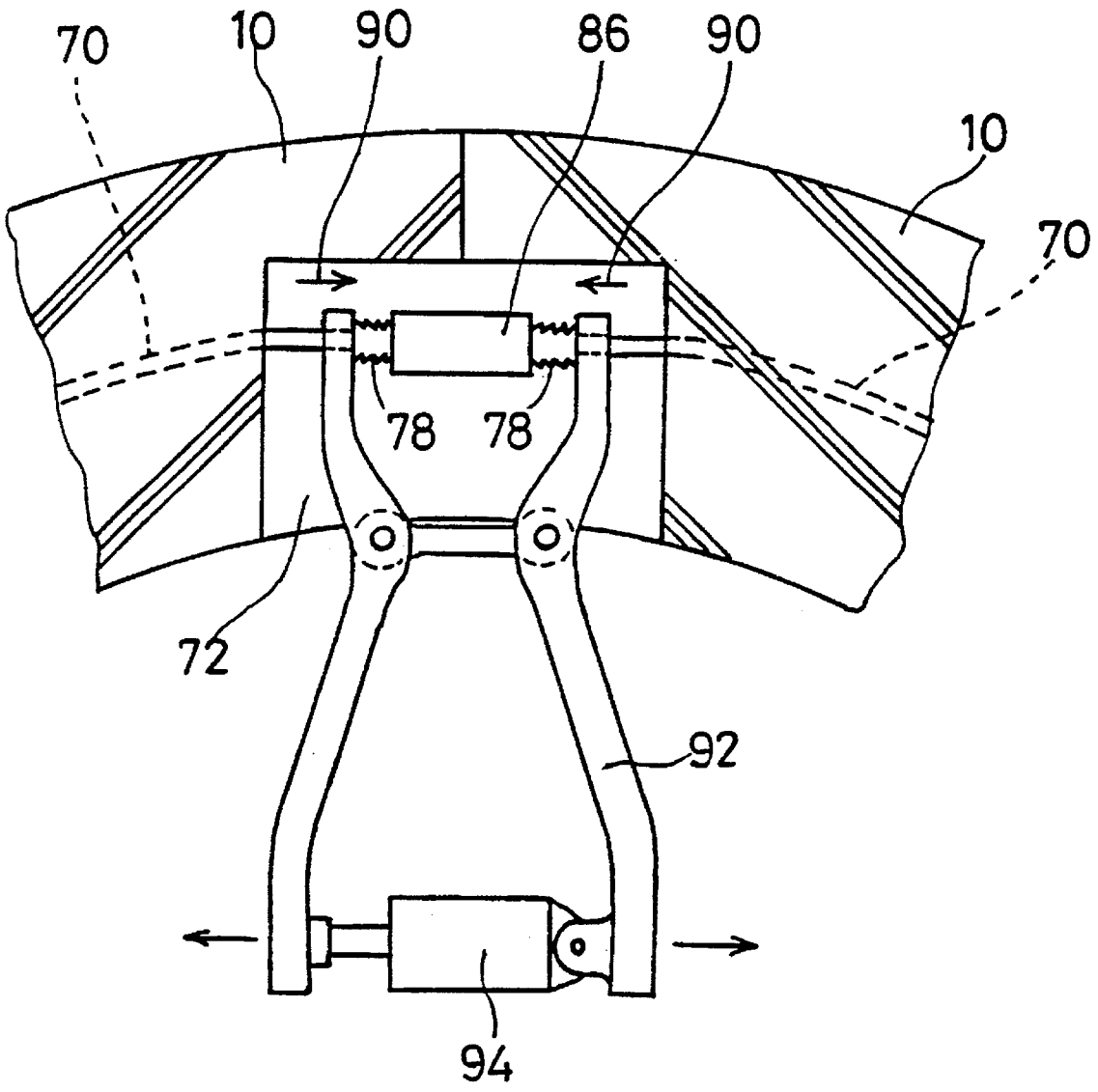
FIG. 15 is a view for explaining the operation of a jack of the embodiment.

A sawtooth-shaped sleeve 78 made of a radially extensible elastic material is externally inserted around the end portion of the unbonded PC steel material 70. As shown in FIG. 13, which is a transverse sectional view taken along the line C—C of FIG. 12, the sleeve 78 has a ring section, with part of the circumference cut-off. The sleeve 78 is fixed to the end portion of the PC steel material 70 by a washer 80 and a nut 82. The sawtooth portion of the outer surface meshes with the sawtooth portion of the inner surface of the fixing coupler 86. FIG. 14 is a view taken along the line D—D of FIG. 12. A jaw 84 of a jack device (not shown) is locked to the rear end of the sleeve 78, and causes the sleeve to advance within the coupler 86. When a sawtooth of the outer surface of the sleeve 78 is slid along the surface of a sawtooth of the inner surface of the coupler, it is contracted in its outside diameter; and when it meshes with the next sawtooth, it is extended in its outside diameter. Namely, both the sawtooth portions mesh with each other just as the meshing between a ratchet and ratchet wheel. FIG. 15 shows a process of withdrawing ends of the PC steel materials to each other by a jack so as to introduce a prestress for fixing. The jack device composed of a jack 94 provided with arms 92 has H-shaped bars whose legs are opened/closed. The H-shaped bars are locked to the rear ends of the sleeves 78 and 78, to withdraw both the ends of the PC steel material 70 in the direction of the arrow 90, thus fixing the sleeves 78 and 78 mounted at the ends of the PC steel materials 70 within the coupler 86.

In the construction of the prestressed concrete tunnel liner of the embodiment, a prestress can be introduced to the ring-shaped PC steel material from the inner side of the liner, thus forming a rigid tunnel liner.

In the prestressed concrete tunnel liner, a prestress is introduced along the circumference, so that it is possible to equalize the distribution of the bending moment when the tunnel liner is applied with a vertical load, to increase the strength, and to enhance the water-tightness at the coupling portions. According to the construction of the present invention, the tunnel liner in which a prestress is easily introduced can be constructed. Moreover, the construction of the present invention can be easily performed using the fixing mechanism and the fixing jack device of the present invention.

In fabrication of a tunnel liner by centrifugal molding, a centrifugal molding form drum has an inside diameter corresponding to the outside diameter of the tunnel liner. The tunnel liner is divided along the circumferential direction into arcuate plate like liners. The divided liners are designed to be tapered in the axial direction for combination, and generally, have not the same shape. Accordingly, in fabrication of the liners having different shapes by the centrifugal form drum, it is required to fabricate the liners having different shapes neither too much nor too little by suitably allocating the forms within the drum.

In the present invention, the tunnel liner is divided along the circumferential direction into liners of n-pieces, and the liners of (n−1) pieces are disposed in the form drum. Thus, the above requirement can be achieved by preparing n-kinds of the above tunnel liners. In addition, <n> is an arbitrary integer. For making easy the fabrication, the following condition is desirable: namely, <n> is five; the arc length of one liner is the quarter arc or less; the drum is divided into the upper and lower parts; and two liners are allocated for each of the upper and lower drum.

Figure 16:
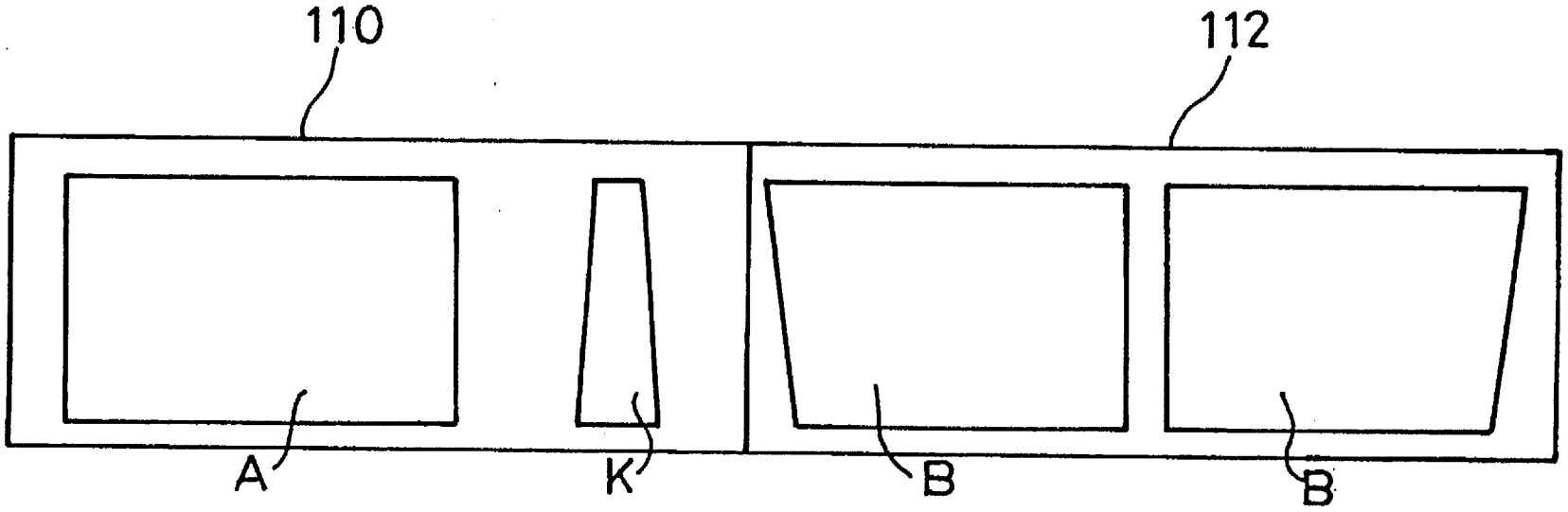
FIG. 16 is a development showing the allocation of the liners in the centrifugal molding drum of the embodiment.
Figure 18:
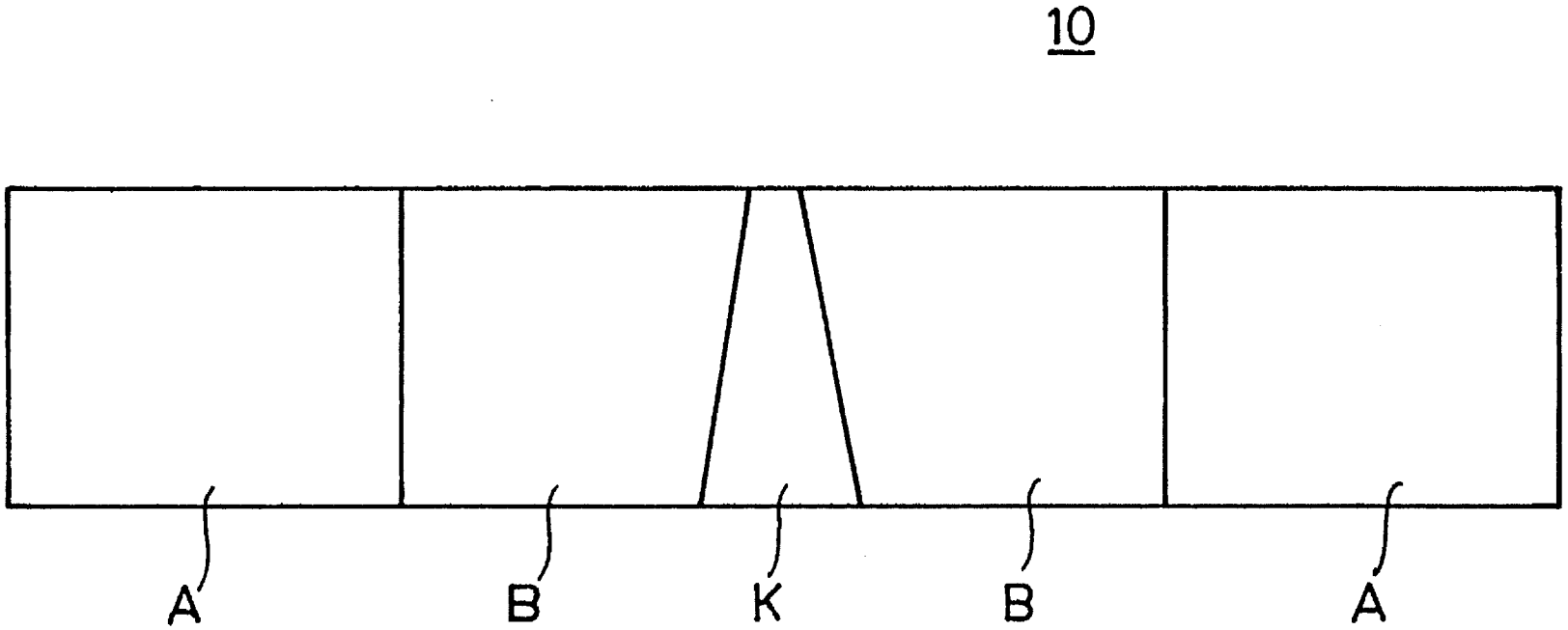
FIG. 18 is a development of the tunnel liner.

FIG. 16 is a development of a centrifugal molding form drum in which four pieces of the above five liners are disposed. In this figure, liners A and K are allocated in an upper drum 100 and 112 liners B and B are allocated in a lower drum 100*b*. Thus, the kinds 1 to 5 of the combinations shown in Table 1 are selected.

TABLE 1

| kinds of combinations | upper drum | lower drum |
|---|---|---|
| 1 | A, K | B, B |
| 2 | A, K | B, B |
| 3 | A, K | A, B |
| 4 | A, K | A, B |
| 5 | A, B | A, B |

In general, when five liners having different shapes are used, the tunnel liner is divided along the circumference into five liners C, D, E, F and G each having an arbitrary arc length not more than the quarter arc, and they may be combined with each other as shown in Table 2.

TABLE 2

| kinds of combinations | upper drum | lower drum |
|---|---|---|
| 1 | C, D | E, E |
| 2 | C, D | E, G |
| 3 | C, D | F, G |
| 4 | F, E | F, G |
| 5 | C, D | F, G |

FIG. 17 is a typical view of the arrangement of a tunnel liner as seen from the end surface of a drum wherein the allocation of liners shown in Table 2 is exemplified. Additionally, in the allocation of Table 2, five kinds of the forms may be realized by preparing two of upper drums having the liners (C, D) and (F, G), and three of lower drums having the liners (E, E), (E, F) and (F, G), and changing the combination of the upper and lower drums.

Moreover, by designing a tunnel liner in which arc lengths are suitable selected, it is possible to allocate the forms into two kinds of a drum form for fabricating the liners (C, D, E, F) and a drum form for fabricating a plurality of the liners (G). At this time, to enhance the efficiency, the liner (G) may be shortened in the arc length.

The process of fabricating a tunnel liner of the present invention will be described below.

(a) Each arcuate enclosed hollow form is filled with concrete, and is vibro-compacted by a vibration-exciter. At this time, the vibro-compacting is performed by holding the form in the posture that one end of each arcuate side plate is high and the other end is low. Thus, concrete on one rectangular end surface and two arcuate side surfaces is tightly compacted onto the inner surface of the form, which prevents the generation of water-path due to an inertia force even in the centrifugal force-compacting of the subsequent process.

(b) In the state that concrete is not hardened, each enclosed hollow form is mounted within a centrifugal drum, and is compacted by a centrifugal force with an acceleration of 20 to 25 G (G: acceleration of gravity).

At this time, the form is mounted within the centrifugal molding drum such that the rectangular side plate positioned on the upper side in the above vibro-compacting is positioned on the upstream side in the rotational direction of the centrifugal molding drum. By the centrifugal force, the arcuate outer surface side of the concrete liner is consolidated and water is squeezed on the inner surface side. Moreover, the above rectangular end surface on the upstream side in the rotational direction is tightly molded. This is due to the rotation of concrete retarded from the rotation of the rotary drum by the inertia force in the centrifugal molding of the arcuate plate-like concrete liner, so that concrete is shifted on the upstream side in the rotational direction and the concrete on the end surface on the upstream side in the rotational direction is tightened. Since the other three surfaces are tightly molded in the above process (a), all of the end surfaces are thus precisely molded. Concrete is separated from the arcuate inner surface plate to form gaps, and water is squeezed by way of these gaps.

(c) Each form is removed from the centrifugal molding drum, and the arcuate inner surface plate is removed to repair and finish the arcuate inner surface of the concrete liner. The concrete liner is then cured.

The apparatus of the present invention is adapted to preferably perform the method of the present invention, and which includes a centrifugal molding drum, and a plurality of individual enclosed hollow forms removably mounted within the centrifugal molding drum. The enclosed hollow form is an assembled body of an arcuate outer surface plate, arcuate inner surface plate, two arcuate side plates and two rectangular side plates. This form can be disassembled such that the concrete product is easily removed therefrom. The outer surface of the form is provided with a mounting mechanism for forcibly mounting the form onto the centrifugal molding drum. The arcuate inner surface plate can be independently removed differently from the above-described disassembling mechanism. Moreover, on the arcuate inner surface plate, an enclosable concrete charge port is provided near one rectangular side plate.

The apparatus used for execution of the process (a) of the above-described fabrication method includes a vibration-exciter for exciting the arcuate enclosed hollow form while holding the form in the posture that one end of the arcuate side plate is high and the other is low, and a concrete supply apparatus moved over the vibration-exciter for supplying concrete in the enclosed hollow form. This apparatus is adapted to precisely mold the end surfaces of the concrete liner before the arcuate enclosed hollow form is mounted to the centrifugal molding drum.

Figure 19:
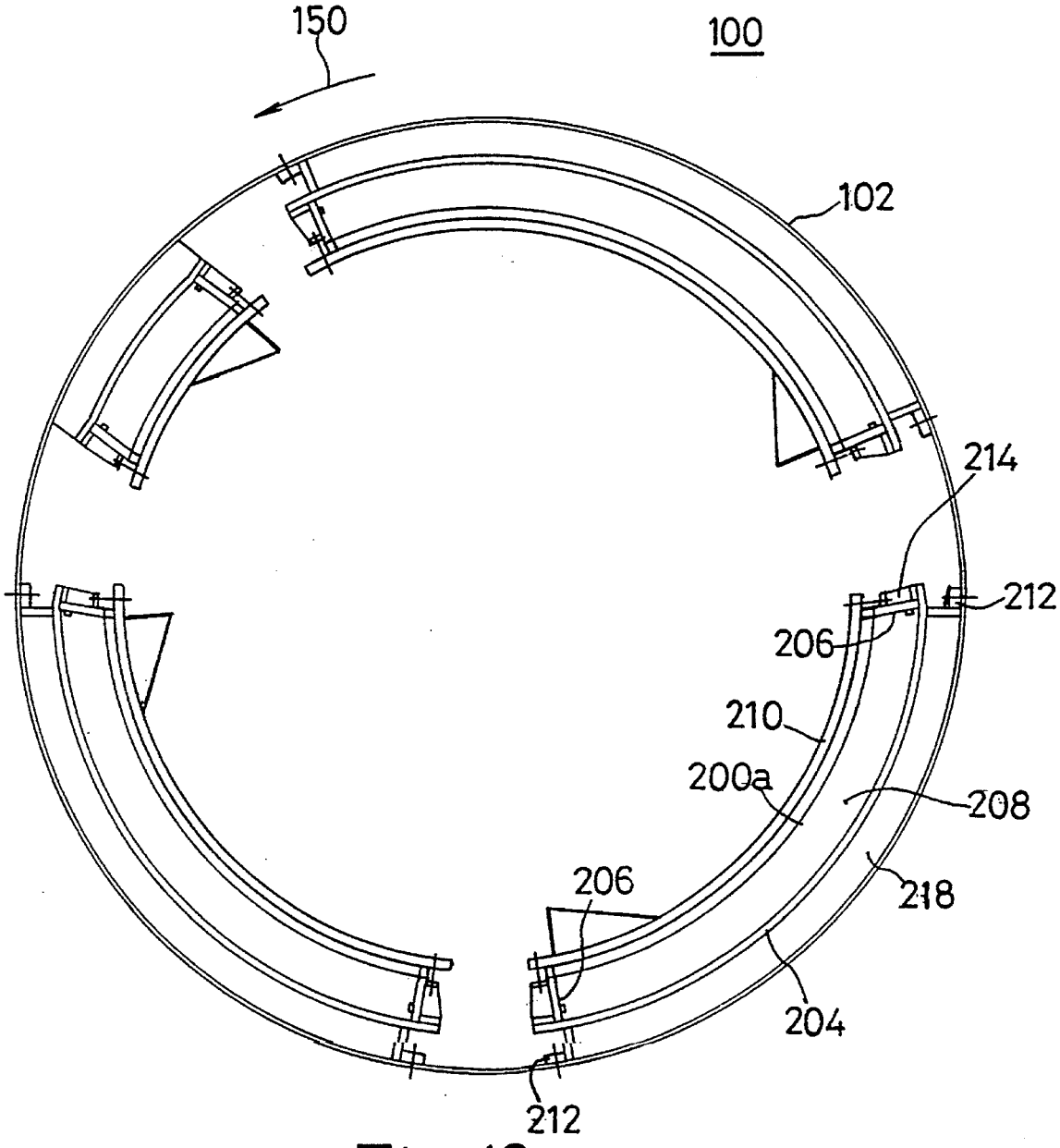
FIG. 19 is a front view showing the mounting of the liner form to the centrifugal molding drum for the concrete liner according to the embodiment.
Figure 20:
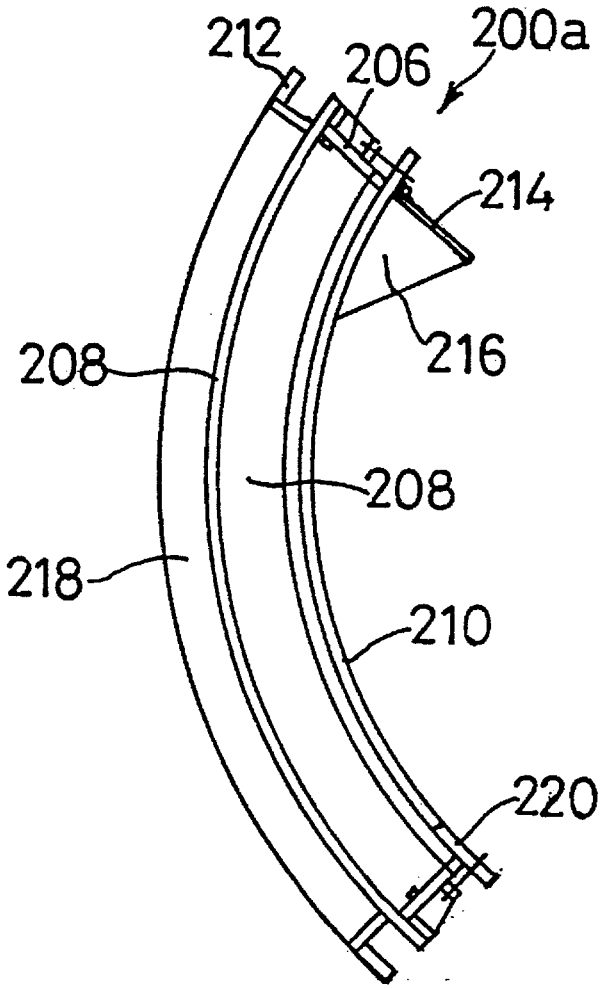
FIG. 20 is a side view of a form of the concrete liner of the embodiment.
Figure 22:
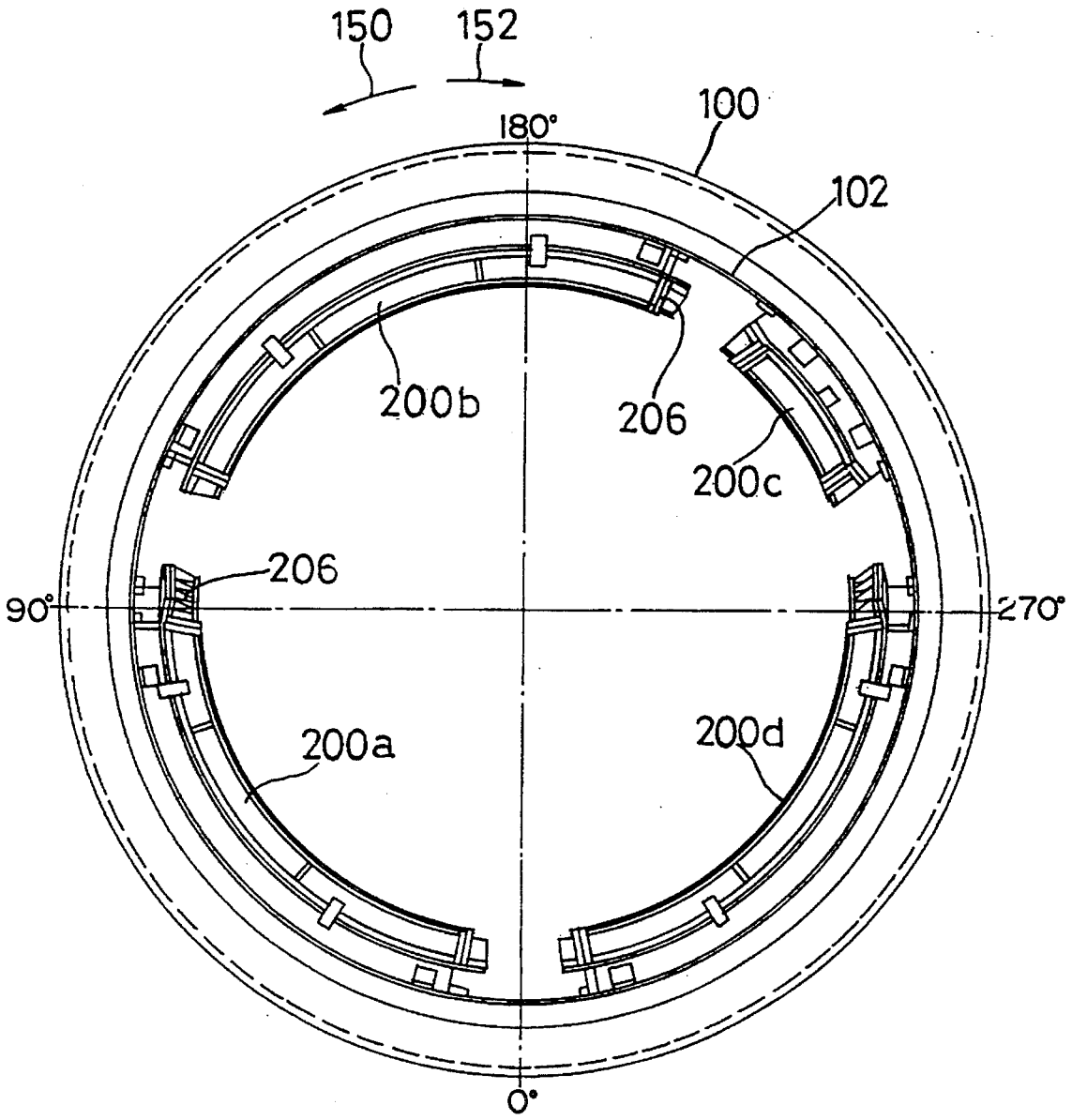
FIG. 22 is a front view showing the mounting of the liner form the centrifugal molding drum for the concrete liner according to the embodiment.
Figure 23:
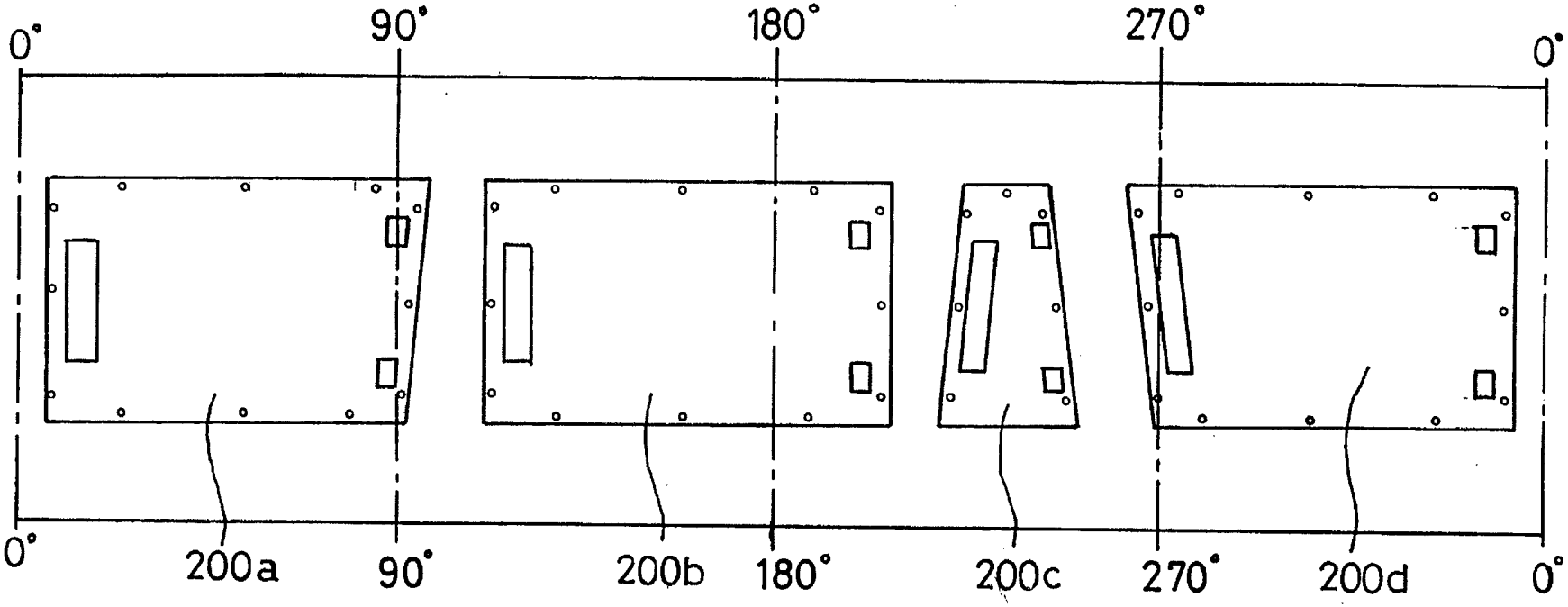
FIG. 23 is a development of the centrifugal molding drum for the concrete liner according to the embodiment.

FIG. 22 is a front view of a concrete liner centrifugal molding drum of the embodiment; and FIG. 23 is a development of the inner surface of the drum. Arcuate concrete liner forms 200*a*, 200*b*, 200*c* and 200*d* are mounted within a shell 102 of the rotary drum FIG. 19 is a front view of the centrifugal molding drum; and FIG. 20 is a side view of the form 200*a*. The form 200*a* for fabricating an arcuate plate-like concrete liner is a compressed arc-shaped enclosed hollow box including a bottom plate 204, rectangular side plates 206, arcuate side plates 208, and an inner surface plate 210. The form 200*a* is removably mounted onto the centrifugal molding drum shell 102 by means of mounting members 212.

The arcuate inner surface plate 210 is removably mounted on the side plates 206 and 208 by means of fixtures, and is provided with a concrete charge port 216 (see FIG. 20). The concrete charge port 216 can be enclosed by opening/closing a shielding plate 214 by means of a hinge structure. The concrete charge port 216 is provided near one rectangular side plate, so that the form 200*a* can be filled with concrete while being held in the posture that the charge port 216 is positioned on the upper side. An air vent hole 220 is provided on the other end of the arcuate inner surface plate 210 for improving the efficiency and assuring the filling. The shapes, and opening/closing mechanism and the enclosing mechanism of the concrete charge port 216 and the air vent hole 220 may be different from the above-described hinge structure.

Figure 21A:
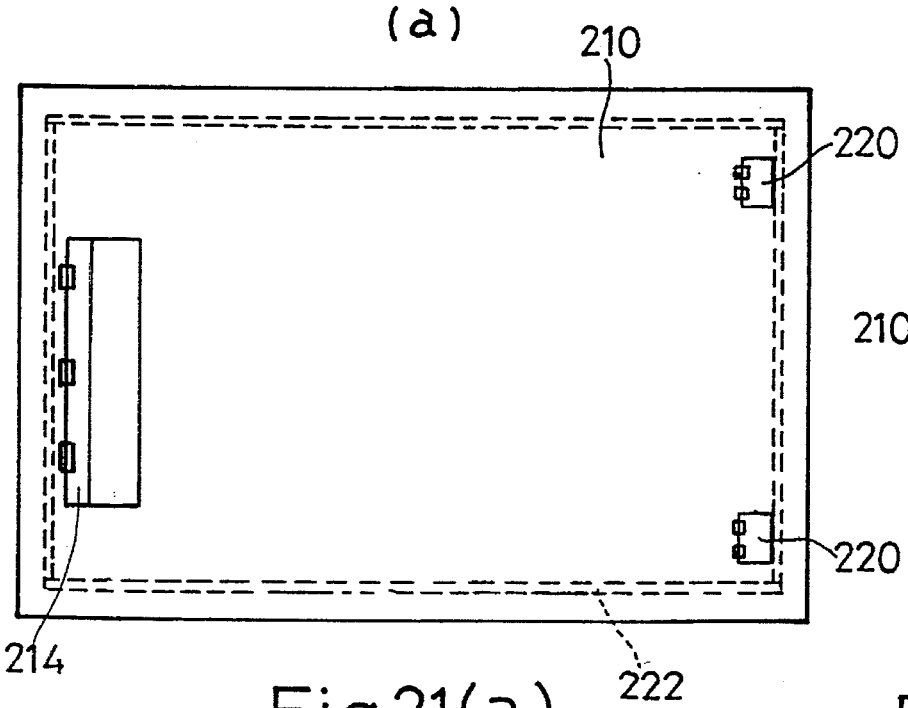
FIGS. 21(*a*) to 21(*c*) is a view of an arcuate inner surface plate of the embodiment; wherein FIG. 21(*a*) is a plan view.
Figure 21B:
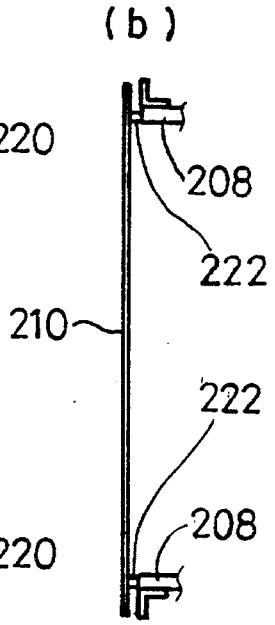
Figure 21C:
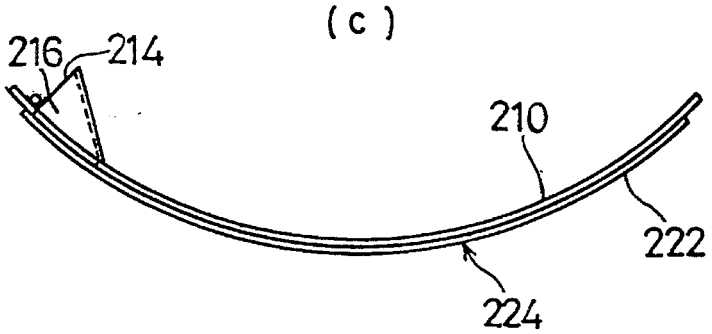

FIGS. 21(*a*), 21(*b*) and 21(*c*) show the arcuate inner surface plate 210, wherein FIG. 21(*a*) is a plan view; FIG. 21(*b*) is a side view; and FIG. 21(*c*) is a front view. A frame-like projection 222 having a specified height is provided on an abutment surface between side plates 206 and 208 around the arcuate inner surface plate 210 on the form inner surface side. The upper surface of the projection 222 is formed with a parting surface 222 with respect to the top ends of the side plates 206 and 208. The height of the parting surface 222 substantially corresponds to the height of a space, which is formed when concrete filled in the form is centrifugal-compacted and consolidated on the outside diameter side so that and the surface on the inside diameter side is separated from the arcuate inner surface plate 210. Namely, the upper edges of the side plates 206 and 208 become finish rulers when the form 200a is removed from the centrifugal molding-drum shell 102 after the centrifugally molding, followed by the removal of the arcuate inner surface plate 210, and the surface of the concrete placed is repaired. By the centrifugal molding, concrete is tightly consolidated on the outer peripheral side, and water is squeezed on the inner peripheral side which forms an irregular surface. The irregular surface is repaired, and then the concrete liner is subjected to steam curing.

Figure 25:
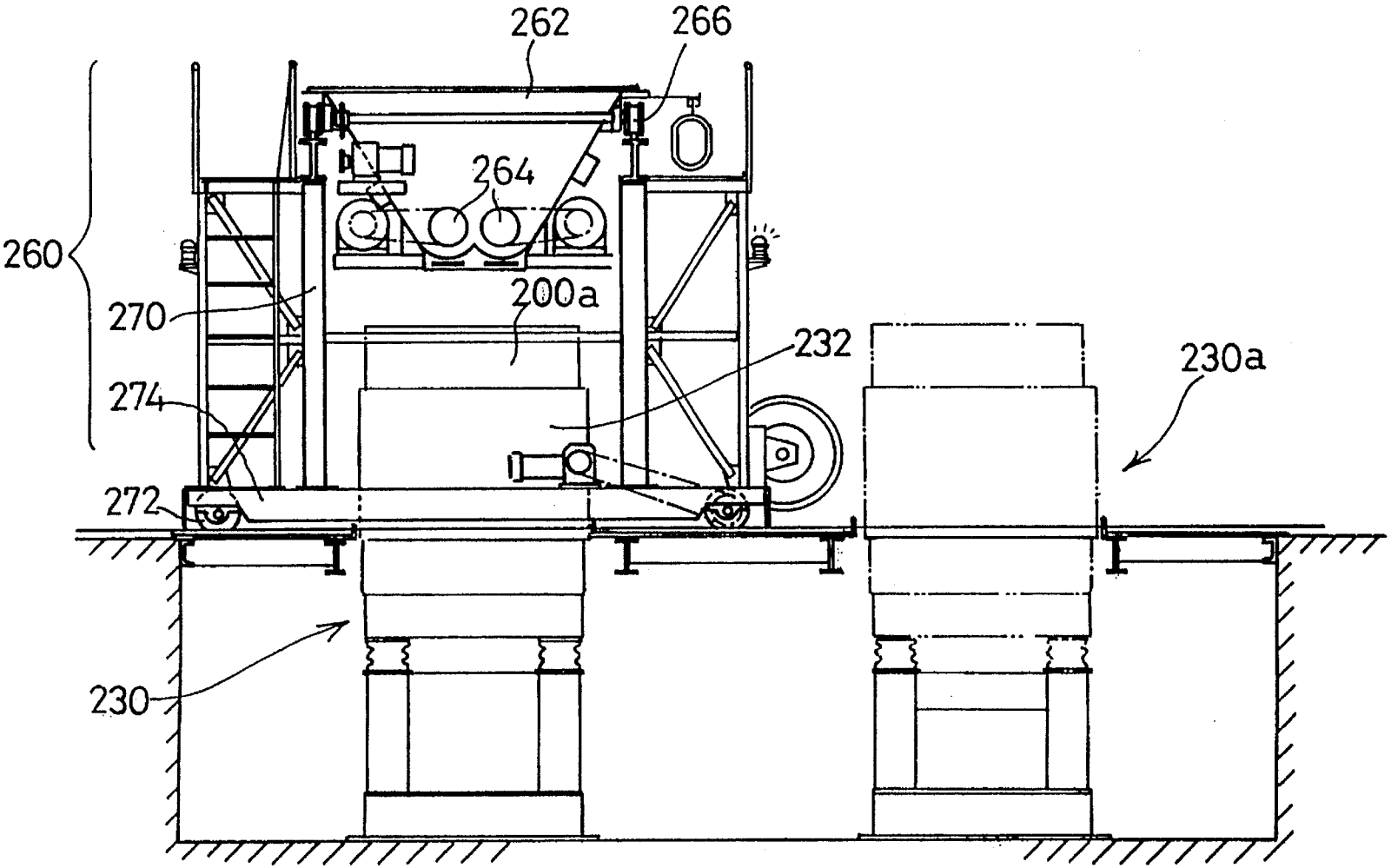
FIG. 25 is a front view of the vibration -exciter and the concrete supply apparatus.
Figure 26:
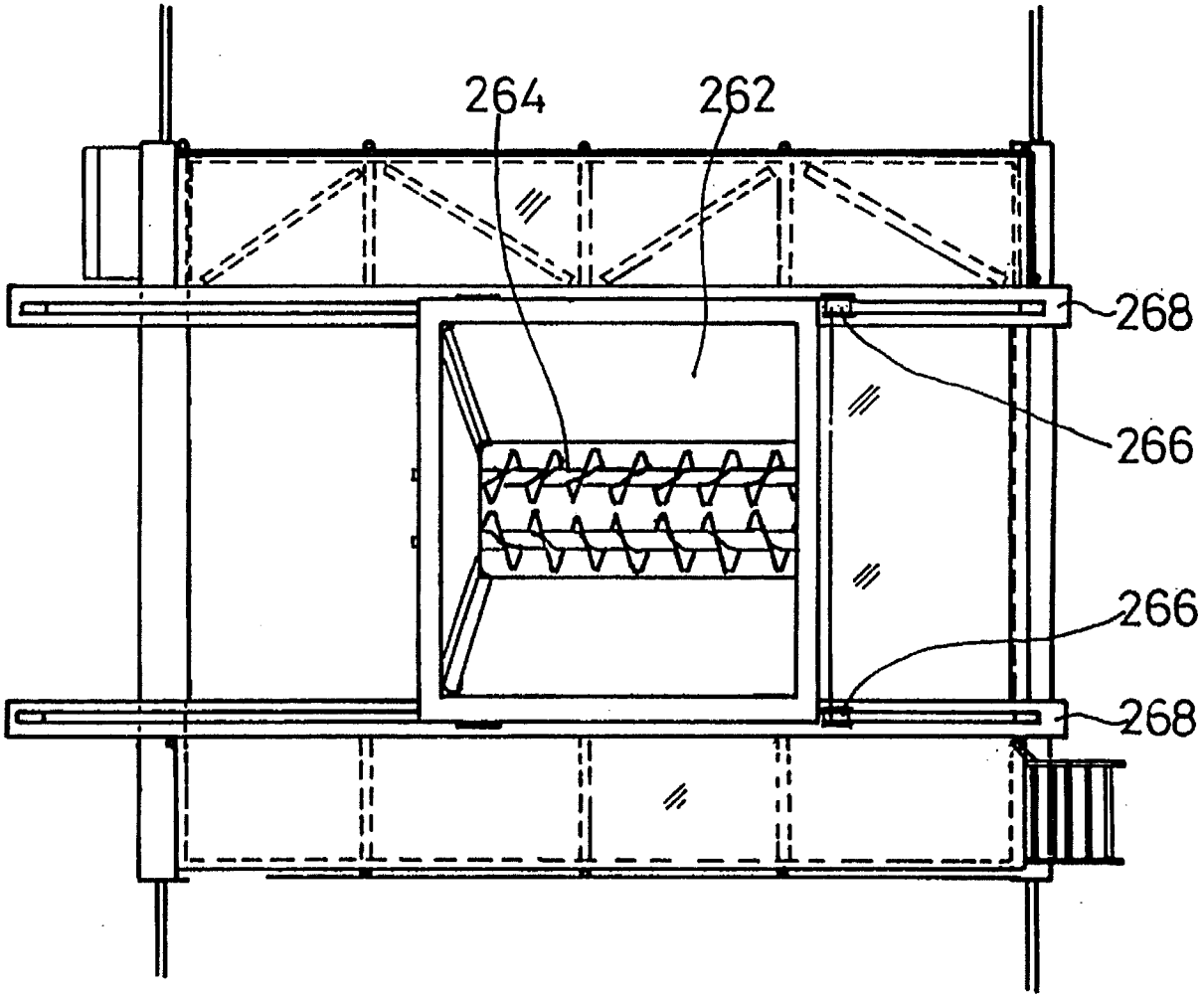
FIG. 26 is a plan view of the concrete supply apparatus.

Referring to FIGS. 22, 25 and 26, the process of placing concrete within a form 200*a* and compacting the concrete, and its apparatus will be described. As shown in these figures, in this process, the form 200*a* is mounted on the vibration-exciter 230, and concrete is supplied from the concrete supply apparatus 260 into the form 200*a*, to be vibro-compacted.

The vibration-exciter 230 is provided with a base 232 on which the form 200*a* is mounted. In the base 232, one end is supported by a pin 232 and the other end portion 228 is supported so as to be movable in the vertical direction. For example, the end portion 248 is fixed to the leading edge of a rope of an elevator 250. The base 232 is fixed with a vibrator 246, and is supported on supporting frames 236 and 238 through flexible supporting bodies 240 and 242, for example coil spring, air spring and rubber, to enhance the exciting effect. The concrete supply apparatus 260 includes a hopper 262 and a screw feeder 262, and which is provided over the vibration-exciter 230 by means of a column 270. The hopper 262 can be moved forward and backward by wheels 272 along rails laid on the frame 268, to supply concrete in the concrete charge port 216 of the form 200*a*. The lower end of the column 270 includes running wheels 272, and can be moved to the position over the adjacent vibration-exciter 230*a*. Accordingly, both the vibration-exciters 230 and 230*a* can be alternately operated.

Figure 24:
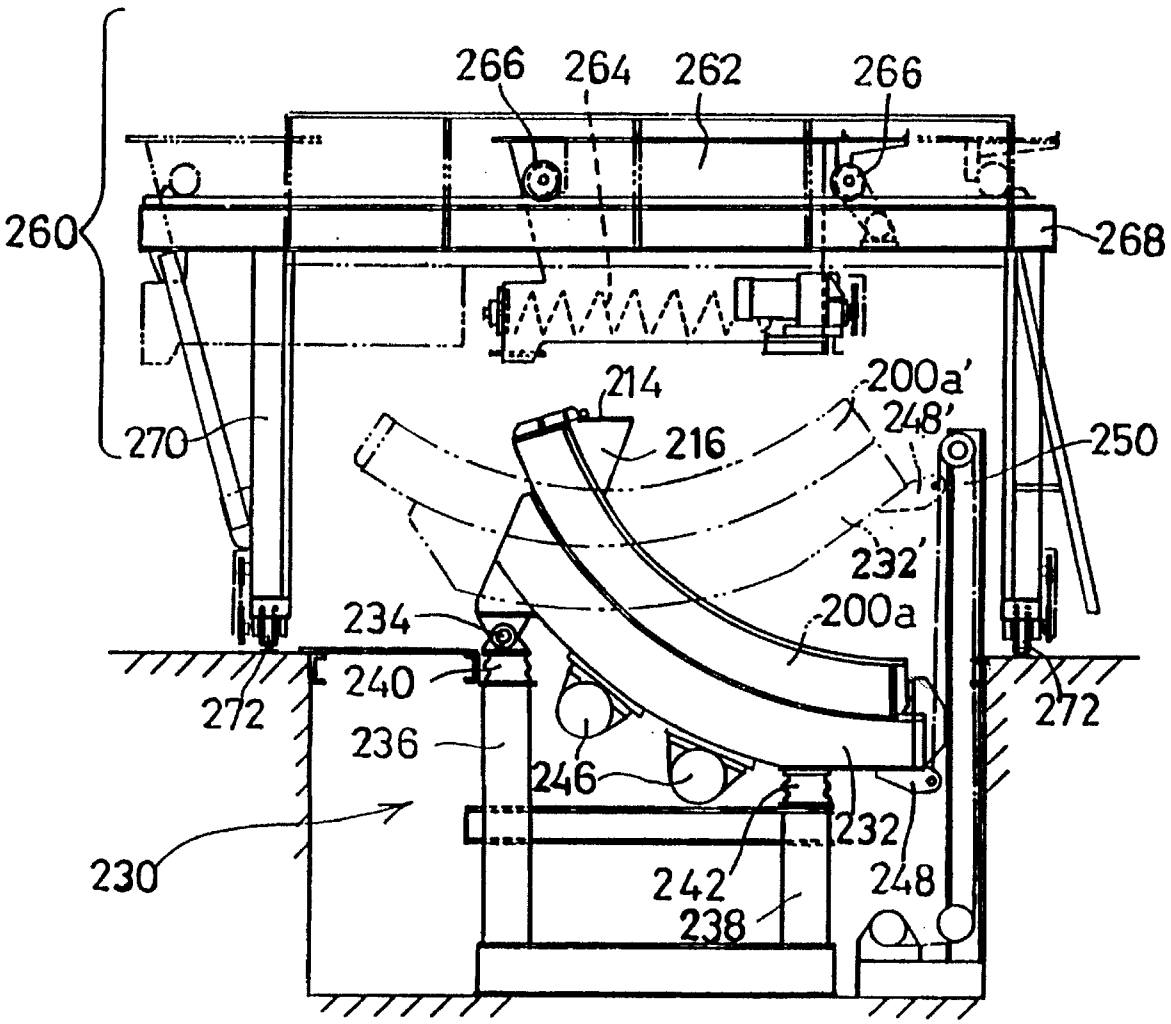
FIG. 24 is a side view of a vibration-exciter and a concrete supply apparatus.

In the stand-by condition of the concrete supply apparatus 260 at the position over the vibration-exciter 230, the base 232 of the vibration-exciter 230 is substantially in the horizontal posture (base 232') as shown by the virtual line (two-dot chain line) in FIG. 24. The form 200*a'* is mounted on the base 232' substantially in the horizontal posture by a crane or the like, and the elevator 250 is operated to lower the end portion 248' of the base 232' to the position of the end portion 248. At this time, the base 232 is rotated around the pin 234, and is supported on the flexible bodies 240 and 242. The concrete supply apparatus 260 is moved over the vibration-exciter 230, and the shielding plate 214 of the form 200*a* is opened to supply concrete from the charge port 216. Subsequently, the shielding plate 214 is closed, and the vibrator 246 is driven to accelerate the charge of the concrete and to compact the concrete. At this time, the lower end side and the side surfaces of the form 200*a* are tightly compacted. The base 232 is returned to the substantially horizontal posture by the elevator 250 after compacting. The form 200*a* is then hung up by the crane or the like to be carried to the position of the drum form, and mounted within the centrifugal molding drum, to be thus subjected to the centrifugal molding treatment.

As shown in FIG. 22, the concrete placed within the form 200*a* receives an inertia force in the direction of the arrow 152 against the rotational direction 150 of the centrifugal molding drum 100, to densify the concrete abutted on the side plates 206 of the form 200*a* on the upstream side in the rotational direction 150. Projections or mortises for forming sealing grooves are provided on the inner surface of the side plate 206, and the concrete surface of this portion is precisely formed. The other three end surfaces are, as described above, vibro-compacted directly after concrete placing, to be thus formed in the precise end surfaces. Thus, all of the peripheral end surfaces of the concrete liner are precisely finished.

According to the present invention, there was fabricated an arcuate concrete liner having a circumference (outside diameter: 2.5 m, thickness: 0.125 m, and axial length: 1.2 m) which is unequally divided into five parts.

As shown in FIG. 24, the assembled form 200*a* was mounted on the base 232 of the vibration-exciter 230. At this time, the form 200*a* was disposed in the posture that one end of the arcuate side plate was positioned on the upper side and the other end thereof was positioned on the lower side. Thus, concrete was supplied from the concrete charge port 216, to fill the form 200*a* with concrete.

The blending of concrete was as follows.

Cement amount: 350 to 450 kg/m3

Ratio of water to cement: 30 to 40%

Coarse aggregate: crushed stone (15 mm), 800 to 1000 kg/m3

Fine aggregate: Minano-produced crushed sand

Sand percentage: 40 to 55%

Slump: 3 to 7 cm

Admixture: 150 to 230 kg/m3

Water reducing agent: 6 to 10 kg/m3

The vibration-exciter 230 was operated to perform the vibro-compacting. The form was then mounted onto the centrifugal molding drum 100, to be centrifugal-molded.

The centrifugal molding was performed as follows.

Low speed (acceleration of centrifugal force: 4G) : 1 min

Intermediate speed (acceleration of centrifugal force 8G): 3 min

Intermediate speed (acceleration of centrifugal force 14G): 3 min High speed (acceleration of centrifugal force 20–25G): 10 min Next, the resultant concrete liner was subjected to high temperature steam curing, and was removed from the form. The concrete of the concrete liner thus obtained was observed in detail, with the result that there was no defect, the outer surface and the peripheral surfaces were precisely finished, and the appearance was beautiful.

In addition, in the above compacting process under the condition of the high speed rotation (20–25 G), by reversing the rotational direction of the form drum, there can be eliminated the shifting of the concrete due to the inertia force with respect to the rotation of the centrifugal molding drum. Accordingly, there was never generated no defect, for example, the water path on one end surface.

According to the present invention, in the centrifugal molding of the arcuate plate-like concrete liner, the concrete surface of the circumferential edge of the liner can be tightly formed in a precise dimension, which makes it possible to fabricate the concrete liner being higher in the quality and is superior in the reliability. Moreover, the concrete is not supplied within the centrifugal molding drum but is certainly supplied within the form by the concrete supply apparatus, so that it is possible to prevent the concrete from being leaked to the outside of the form. This makes it possible to enhance the yield, to remove the scattered concrete in the centrifugal molding drum, to eliminate the cleaning, and to make easy the maintenance.

Next, there will be described a method of fabricating a large diameter tunnel liner using a small diameter centrifugal molding drum.

A separate form having a radius larger than that of a centrifugal molding drum is mounted on the centrifugal molding drum. Concrete is placed within the form, and is applied with a centrifugal force for compacting, to thus form a concrete having uneven wall thickness (the radius of the bottom plate of the form becomes the outside diameter, and the radius from the center of the drum becomes the inside diameter). The concrete is removed from the centrifugal molding drum together with the form before being solidified, and the excessive thickness on the inside diameter side of-the concrete is cut off, to fabricate the large diameter tunnel liner.

Since the form of the tunnel liner is removed from the centrifugal molding drum and the concrete is processed, the processing can be easily and accurately performed. Moreover, since the separate form is mounted to the centrifugal molding drum and the centrifugal molding for the next product can be made, it is possible to fabricate the tunnel liner effectively.

The concrete, which is not sufficiently solidified, can be easily cut off. In the centrifugal molding, there is a fear that there occurs defects on the inside diameter side, so that the removal of the excessive thickness portion on the inside diameter side is desirable.

According to the present invention, it is possible to fabricate the tunnel liners having a plurality of kinds of diameters using the same centrifugal molding drum, and hence to reduce the equipment cost.

Figure 27:
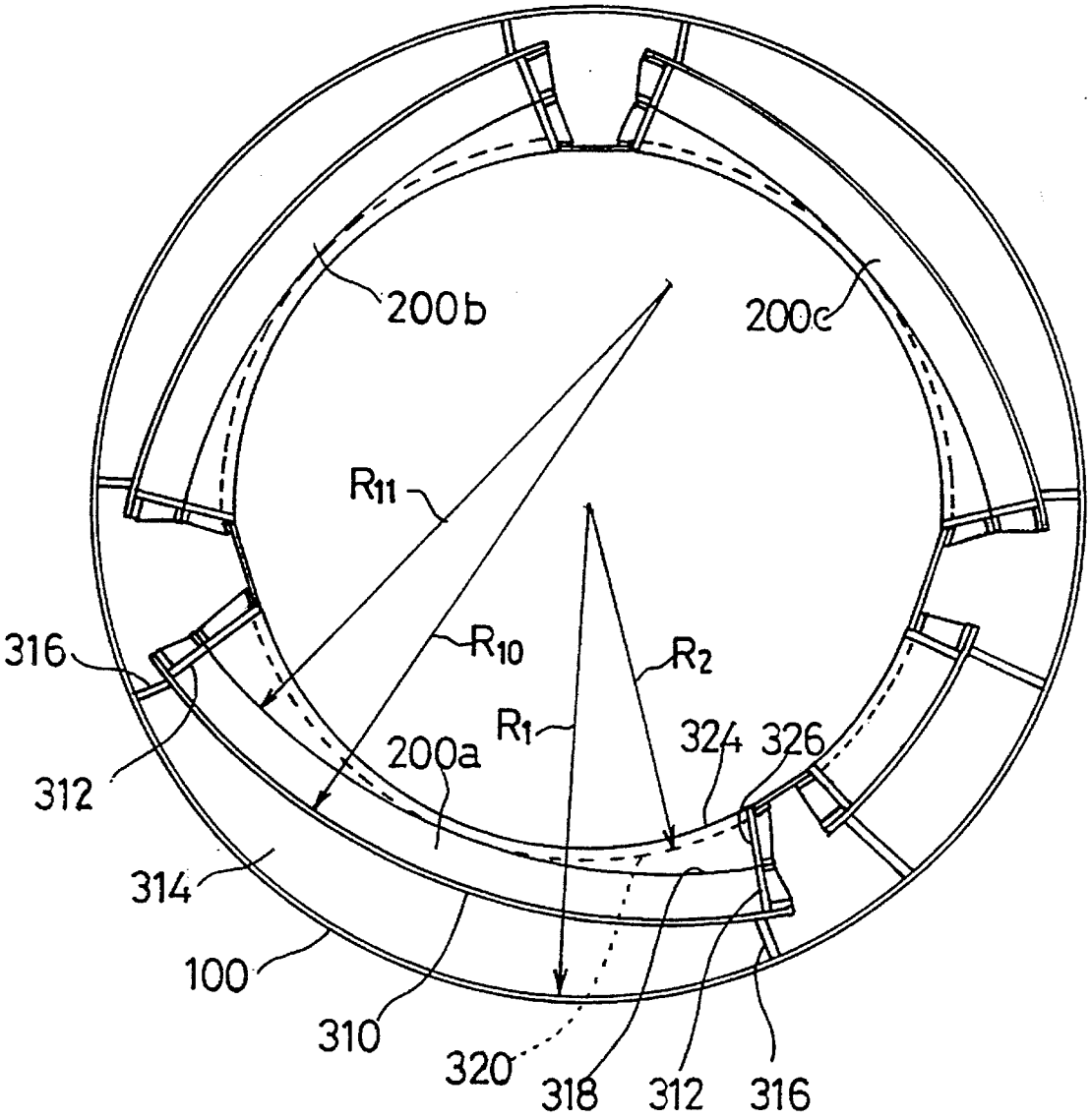
FIG. 27 is a transverse sectional view of a large diameter tunnel liner of the embodiment.
Figure 28:
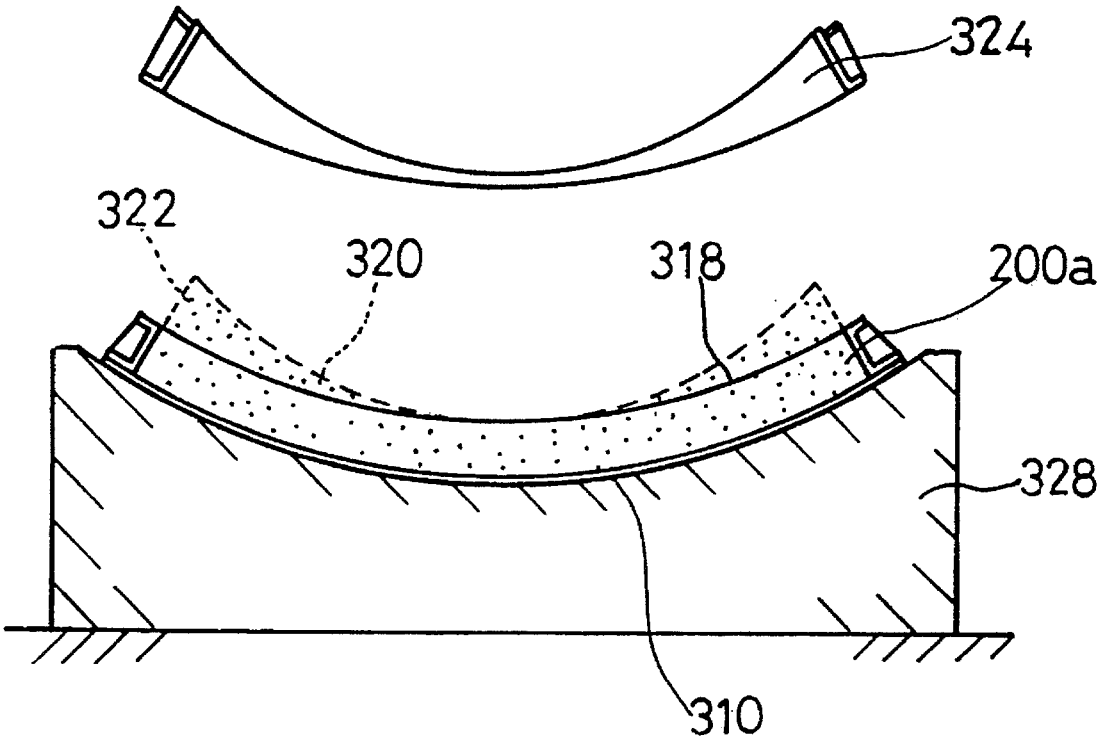
FIG. 28 is a view for explaining a process of removing the excessive thickness of the tunnel liner.

FIG. 27 is a view for explaining a centrifugal molding drum used for the fabrication of a tunnel liner of the present invention; and FIG. 28 is a view for explaining the process of removing the excessive thickness portion.

Forms 200*a*, 200*b* and 200*c* for an arcuate tunnel liner having an outside diameter 2 R10 =4 m were mounted within a centrifugal molding drum 100 having an inside diameter 2 R1 =3 m by way of reinforcing plates 314 and mounting fixtures 316. The form is composed a bottom plate 310 and side plates 312, and the upper surface of the form has an inside diameter 2 R11 . An auxiliary form 324 was mounted on the upper surface 318 of the form. The auxiliary form 321 corresponds to the upper surface 318 of the form 200*a*, and is closely contacted with the upper surface 318 without no gap. While concrete is placed within the form 200*a*, the centrifugal molding drum 100 is rotated, to mold a concrete product having an outside diameter surface formed by the surface of the bottom plate 310 and the upper surface 320 of the same radius R2 from the center of the drum 100. The concrete product is removed from the centrifugal molding drum 100 together with the form 200*a* after the centrifugal compacting is completed.

The form 200*a* removed from the centrifugal molding drum 100 is mounted on a base 328 as shown in FIG. 28. Subsequently, the auxiliary form 324 is removed upwardly. Then, an excessive thickness portion 322 is cut-off along the upper surface 318 of the form 200*a* using scraper, rotating cutter, wire brush or the like.

At this time, since the concrete is not solidified after compacting, the excessive thickness portion 522 can be easily removed. After that, the concrete product is cured and removed from the form in the conventional manner, to thus obtain a tunnel liner product.

According to the fabrication method of the embodiment, it is possible to easily fabricate a large diameter concrete tunnel liner with a good quality which has a tight inner surface and the smoothly cut-off outer surface using a small diameter centrifugal molding drum.

Next, there will be described a means of mounting a form to a centrifugal molding drum in the fabrication method for the tunnel liner according to the present invention.

A hook locked on both the end surfaces of the form is locked to or removed from the projection provided on the outer surface of the form by one action, to hold the form without the generation of the drop and shifting. Accordingly, in this embodiment, an L-shaped hook is engaged with an operating rod so as to be rocked and to be stopped at a specified position. The operating rod is a rotating rod provided with a normal/reversed screw. The normal/reversed screw is screwed to a nut, and the rotating rod is normally and reversely rotated and stopped, so that the nut is engaged with the L-shaped hook and is rocked.

The normal/reverse screw is moved to allow the nuts to be close to and separated from each other accompanied with the normal and reversed rotation. Accordingly, the L-shaped hook engaged with the nuts is operated to be close to or separated from both the end surfaces of the form. Moreover, the rotating rod is left as being locked at the position during the stoppage.

Figure 29:
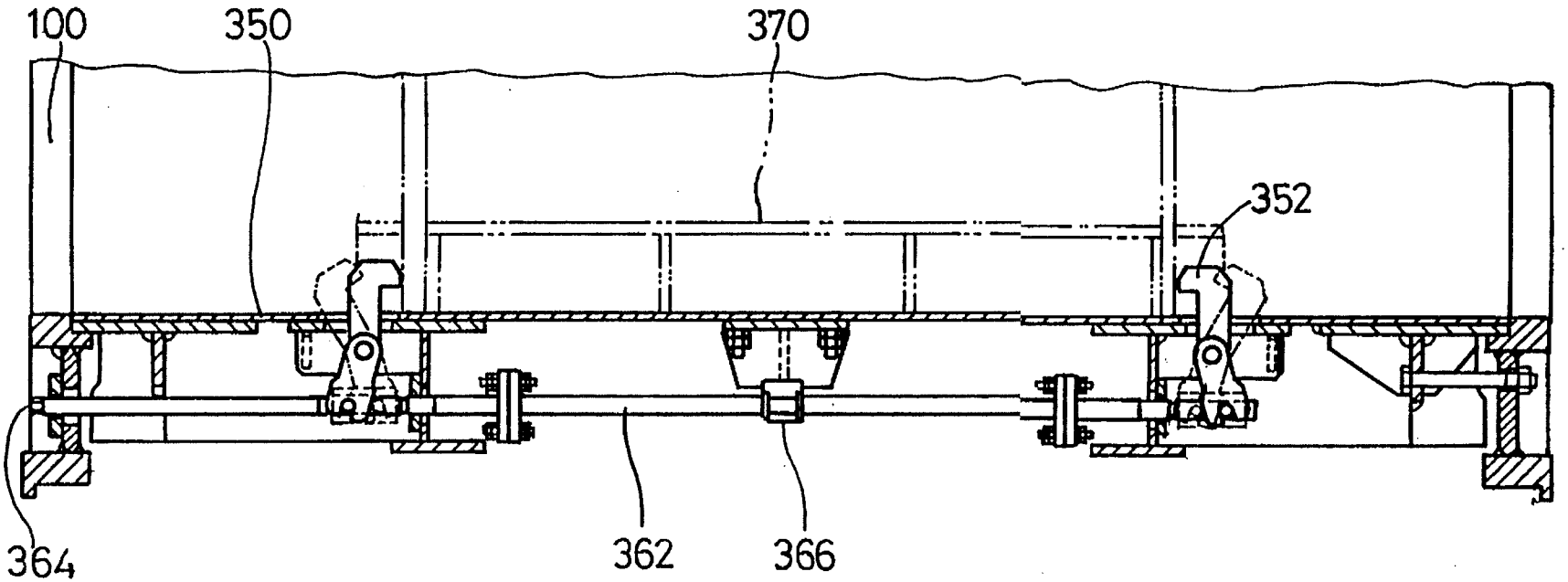
FIG. 29 is a vertical sectional view (side view of a form holding mechanism) of the embodiment.
Figure 30:
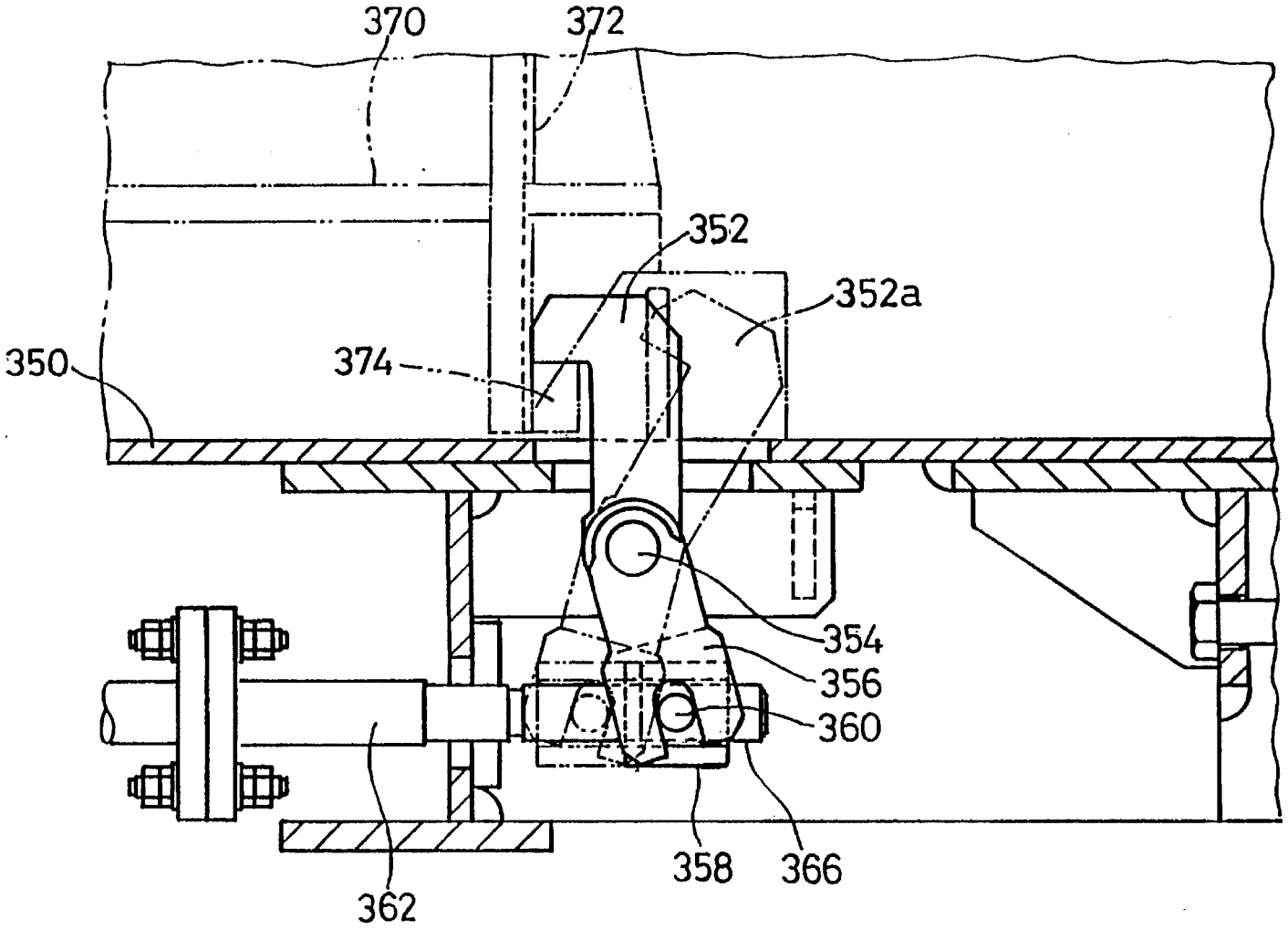
FIG. 30 is partial enlarged view of the drum.

FIG. 29 is a vertical sectional view of the drum 100 showing a portion of the form holding mechanism; and FIG. 30 is a partially enlarged view of FIG. 29.

The arcuate concrete liner form 370 is mounted on the inner surface of the wall 350 of the centrifugal molding drum 100. Projections 374 are provided on end plates 372 on both sides of the form. The L-shaped hook 352 is engaged with the projection 374 to hold the form 370 on the inner surface of the wall 350 of the drum 100. Moreover, the end plate 372 holds the form 370 so as not to be shifted in the axial direction of the drum.

The L-shaped hook 352 is provided while passing through the wall 350 of the drum 100. In the L-shaped hook 352, the center portion is rotatably supported by a pin 354 while the other end 356 is engaged in the U-groove with the pin 360 of the nut 358. The nut 358 is screwed to a screw of the rod 362, and it is moved forward and backward along the rod by twisting the rod 362 around the end portion 364.

Accordingly, the L-shaped hook 352 is rocked between the position where it is engaged with the projection 374 of the form 370 and the position (352*a*) where it is disengaged therewith.

In the centrifugal molding apparatus for the concrete liner according to the present invention, it is possible to mount and remove the form to and from the centrifugal molding drum by one action, and to certainly hold the form. Accordingly, it is possible to achieve the manpower-saving and enhance the productivity for the concrete liner.

Next, there will be described an apparatus of rotating the centrifugal molding drum little by little, and safely stopping it at the arbitrary position when the arcuate form of the concrete liner is mounted or removed to or from the centrifugal molding drum.

In the present invention, the form filled with concrete is mounted within the centrifugal molding drum and is subjected to the centrifugal molding. In the form mounting process, the above apparatus is intended to safely operate the centrifugal molding drum in which the weight distribution in the circumferential direction becomes unbalance.

To achieve the above object, a transmission device between the drum and a drive unit is constituted of a slip-free apparatus such as a pinion-spur gear combination. The spur gear is preferably composed of a pin-roller gear in which a roller pin is disposed along the circumference in place of the tooth. At this time, the pinion is of a sprocket type. The auxiliary drive unit does not require the high rotation of the drum, and is sufficient to be small in power. However, the unit is required to output a torque larger than the turning torque due to the unbalance of the drum, and to be provided with a holding mechanism for holding the weight unbalance of the drum upon stoppage, for example a reversed rotation preventive apparatus or a rotation preventive apparatus. The examples of the apparatuses include a suitable apparatus for preventing the rotation of the drive side from the driven side upon stoppage, for example brake unit, ratchet reversed rotation preventive apparatus, a warm wheel system and the like.

Moreover, the drive unit is required to be released in meshing with the centrifugal molding drum except for mounting and removal of the form or repair of the centrifugal moulding drum. Accordingly, the whole auxiliary drive unit is adapted to be moved forward and backward using a screw feeder or the like.

Figure 31:
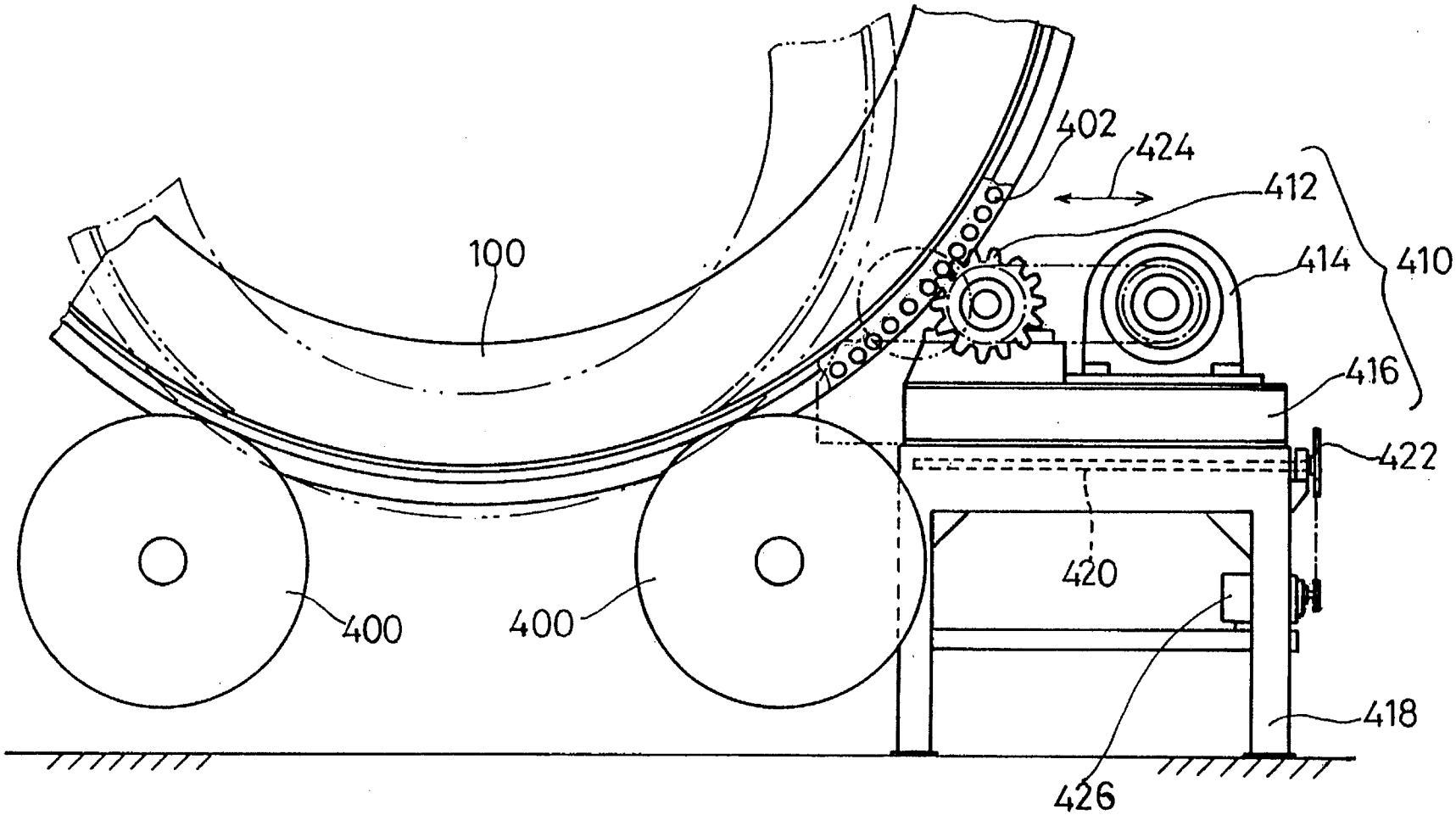
FIG. 31 is a front view of the drum of the embodiment.
Figure 32:
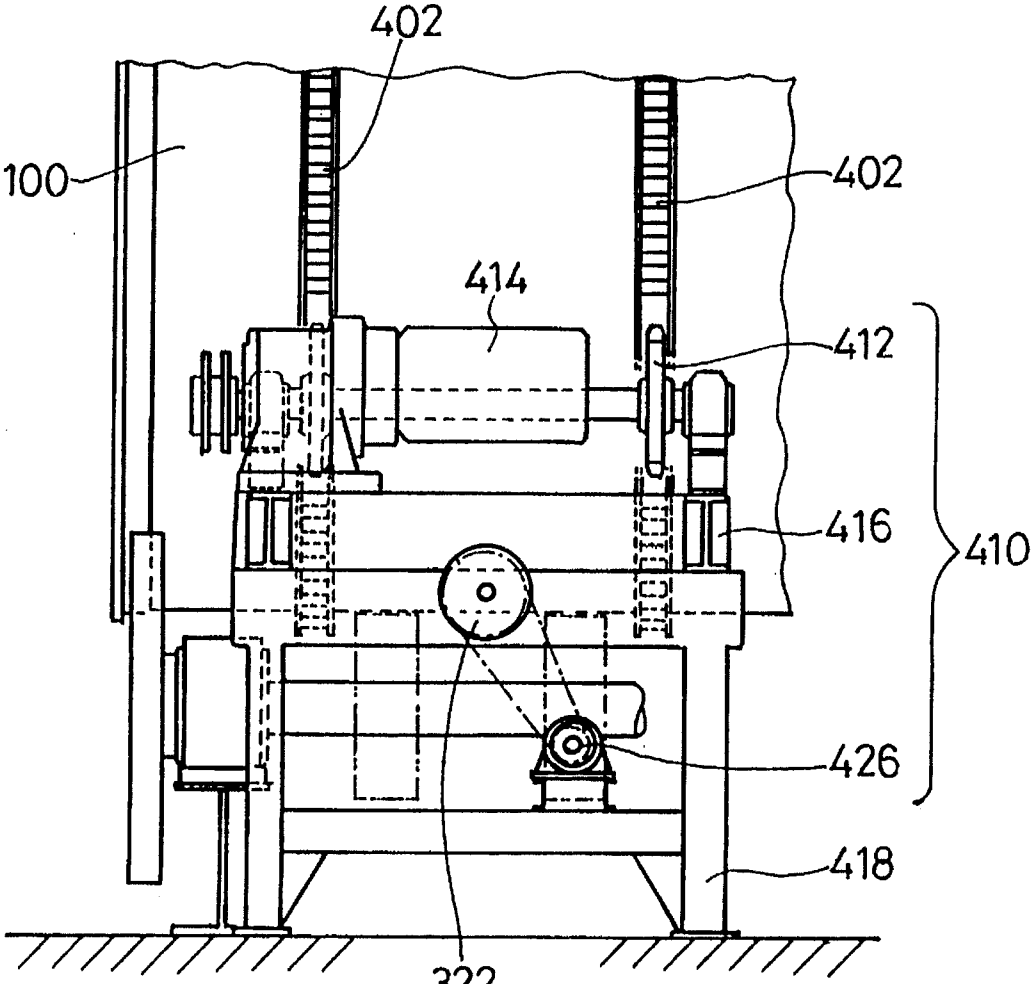
FIG. 32 is a side view of the drum.
Figure 33:
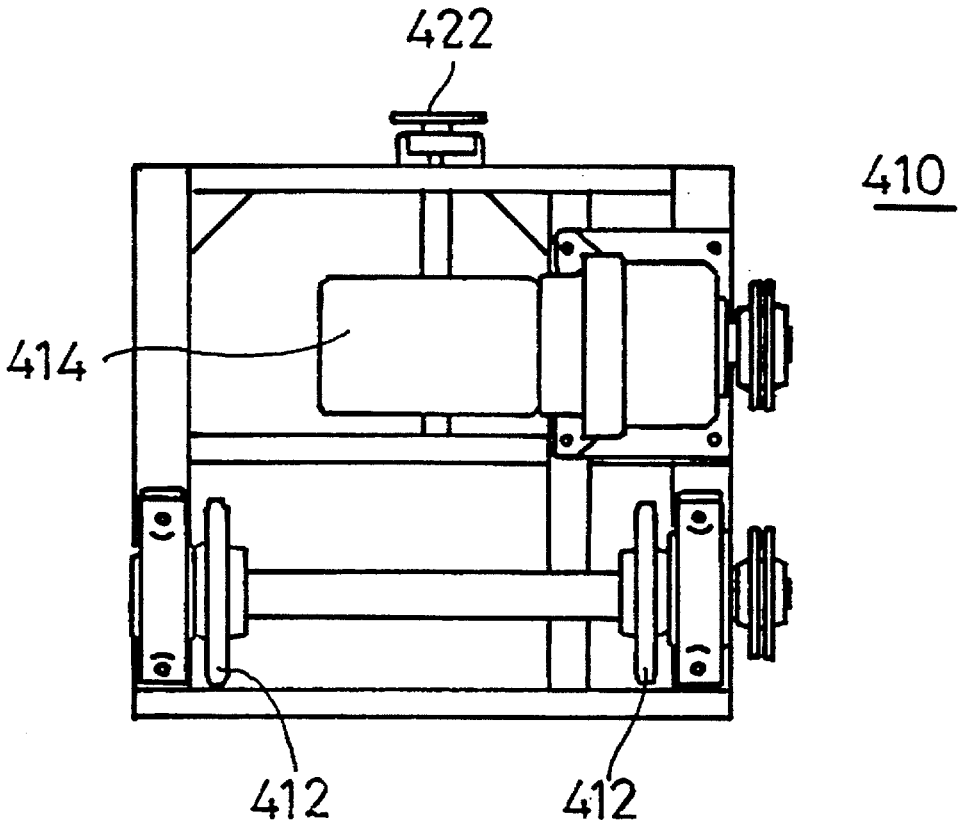
FIG. 33 is a plan view of an auxiliary power unit.

FIG. 31 is a front view of a centrifugal molding drum 100 showing the embodiment of the present invention; FIG. 32 is a side view of the drum 100; and FIG. 33 is a plan view of the auxiliary power unit 10. The drum 100 is mounted on the liner wheel 100, and is rotated at a high speed by a rotating unit (not shown), to centrifugal-mold the concrete liner. The arcuate form (not shown) for the concrete liner is mounted within the centrifugal molding drum 100.

A pin roller gear 402 is mounted around the outer periphery of the drum. The auxiliary power unit for low speed rotation has a sprocket 412 meshing with the pin roller gear 402. The sprocket 412 is rotated by a reduction motor 414. The reduction motor 412 and the sprocket 412 are mounted on a frame 416, and the frame 416 is moved forward and backward along a base frame 418. The advancing/retracting mechanism is a screw type direct retracting mechanism in which a screw a 420 is rotated by the rotation of the sprocket 422 by the motor 226, which is advanced and retracted as shown by the arrow 424.

In the apparatus of the embodiment, the auxiliary power unit 410 is easily meshed with the pin roller gear of the centrifugal molding drum, so that the unbalanced drum is rotated by a specified angle and kept in its posture, which makes it possible to effectively execute the mounting and dismounting of the form with safety.

Moreover, there will be described a centrifugal molding drum which is rotated within the horizontal plane around the vertical center axis. The conventional centrifugal molding drum has the rotation axis disposed in the horizontal direction and is rotated within the vertical plane. In this case, the centrifugal molding drum is provided with a plurality of steel made tires spaced apart from each other in the longitudinal direction around the outer peripheral surface, and which is rotated while the tires are rotatably supported by two rollers. The two rollers receive the vertical weight together with the horizontal weight, and is used in the severe condition.

The above centrifugal molding drum requires a structure with a high rigidity for preventing the deformation of the drum. In the centrifugal molding for the tunnel liner, an acceleration being several times that of the gravity is applied to concrete. The concrete is disposed unevenly within the centrifugal molding drum, so that there occurs a significant unbalance due to the centrifugal force along the circumference of the drum, resulting in the deformation of the drum. To prevent the deformation of the drum, the rigidity of the drum must be further enhanced.

As compared with the conventional centrifugal molding drum described above, the centrifugal molding drum of the present invention is rotated within the horizontal plane around the vertical axis, so that the vertical weight of the drum can be received by a plurality of the receiving rollers. Accordingly, the load in the radial direction of the drum, that is, in the centrifugal force applying direction can be received by a plurality of the receiving rollers serving as drive rollers, to eliminate the necessity of provision of the drum with a high rigidity even when the concrete disposed in the drum is uneven. Moreover, there is eliminated the necessity of mounting a counter weight or the like to equalize the unbalance of the concrete.

Accordingly, a large diameter drum rotated at a high speed can be easily fabricated, and a large diameter tunnel liner can be fabricated using the above drum.

Moreover, since the upper portion of the drum is opened, the mounting and dismounting of the form are made easy.

Figure 34:
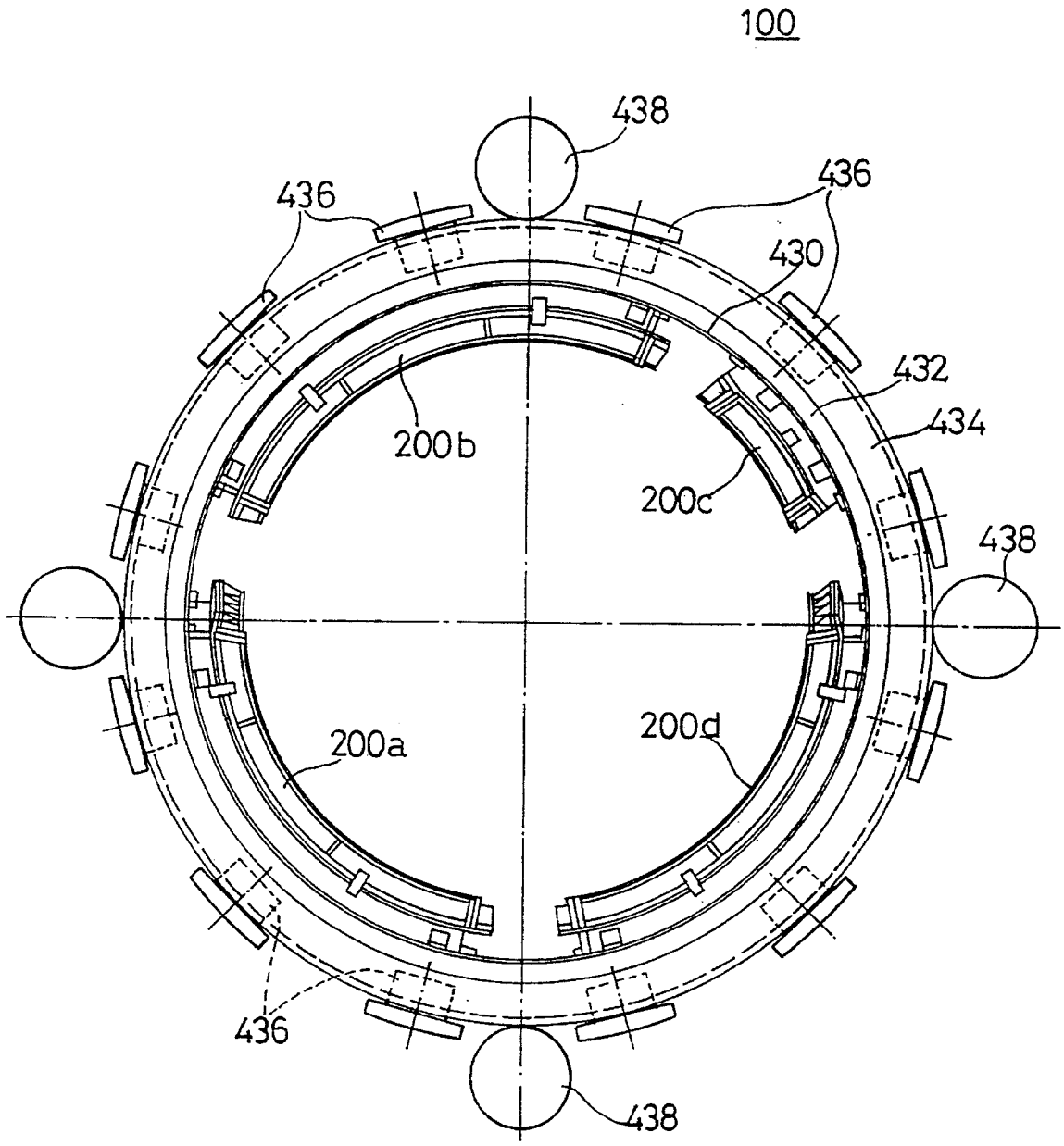
FIG. 34 is a plan view of a form of the centrifugal molding drum for the tunnel liner of the embodiment.

FIG. 34 is a plan view of the centrifugal molding drum 100 of this embodiment.

Each of arcuate forms 200*a*, 200*b*, 200*c* and 200*d* constitutes an enclosed hollow form obtained by integrally assembling an arcuate bottom plate, peripheral side plates surrounding the four peripheries of the tunnel liner and an arcuate inner surface plate; and it is mounted on the inner surface of a centrifugal drum shell 430. The mounting portion is reinforced by a shape steel flange 432 wound around the outer periphery of the drum shell 430.

Tires 434 are provided around the outer periphery of the drum shell 430, but the drum shell 430 is not particularly heavily reinforced to enhance the rigidity.

The steel tires 234 are supported by a plurality of receiving rollers 236 for receiving a vertical load.

Moreover, the steel tires 232 are radially supported by drive rollers 438 provided around the outer peripheries thereof. The drive roller 238 is pushed to the steel tire radially outwardly from the drum by a pushing apparatus (not shown), and is rotated by a drive unit (not shown) for rotating the steel tire 232 in the horizontal direction. At least two drive rollers 438 are provided at positions of the drum spaced apart by a center angle of 180°. A plurality of drive rollers 438 are preferably provided at the positions being symmetric with respect to the center of the drum.

Each form of the tunnel liner, for example 200*a* has a construction shown in FIG. 20.

By use of this apparatus, it is possible to easily fabricate a tunnel liner with accurate dimensions wherein the form is easily incorporated, and is easily removed, without any drum shell with a high rigidity. In particular, by use of this apparatus, a large diameter tunnel liner can be easily centrifugal-molded.

A composite tunnel liner of the present invention will be described. The composite tunnel liner is so constructed that a steel or FRP box, which is formed of a bottom plate, and side plates erected around the four peripheries of the bottom plate, is filled with concrete.

The outside diameter and the side end surfaces of the composite tunnel liner are covered with a steel plate or FRP, and which is high in rigidity, excellent in toughness, and excellent in sealing performance for the coupling portions between the liners. Moreover, the box is integrally formed, which prevents the cement paste leakage upon centrifugal molding of concrete, resulting in the tight concrete product.

In the fabrication of the composite tunnel liner, a doweled reinforcements and ribs are freely fixed within the steel or FRP made box, which makes it possible to save the amount of the steel bar, and to eliminate the steel reinforcing work and mounting. The inexpensive concrete may be fabricated using the low cement content ratio, and further a rigid concrete may be easily fabricated using the concrete with zero slump.

The liners of forming one circumference of the tunnel liner can be fabricated one time by disposing the steel or FRP made boxes in the centrifugal molding drum so as to abut on each other. Moreover, when the steel or FRP made boxes are assembled as the tunnel liner by a method wherein they are coupled by coupling bolts and assembled to form a set of circumferential lines, they can be coupled by means of the same coupling means, to obtain the circumferential liner with the same arrangement as that fabricated within the centrifugal molding drum. This makes it possible to significantly reduce the assembling work.

Figure 35:
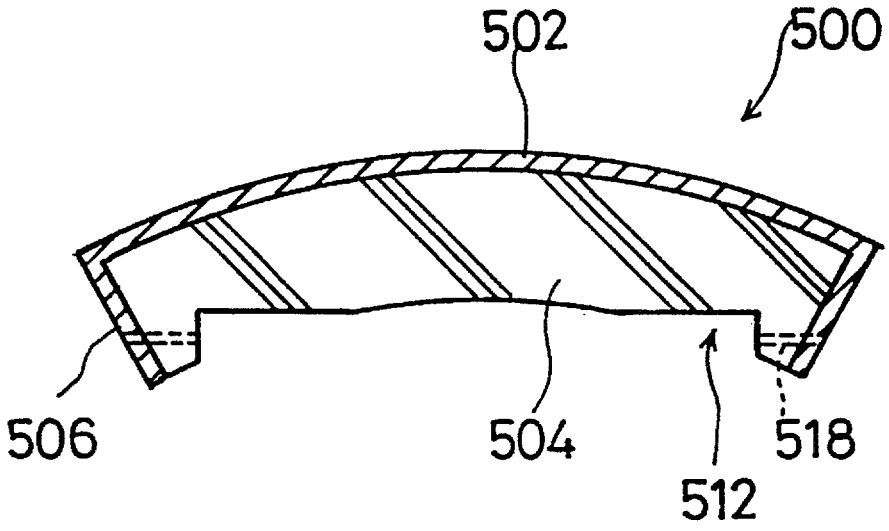
FIG. 35 is a sectional view showing the structure of the tunnel liner of another embodiment.
Figure 36B:
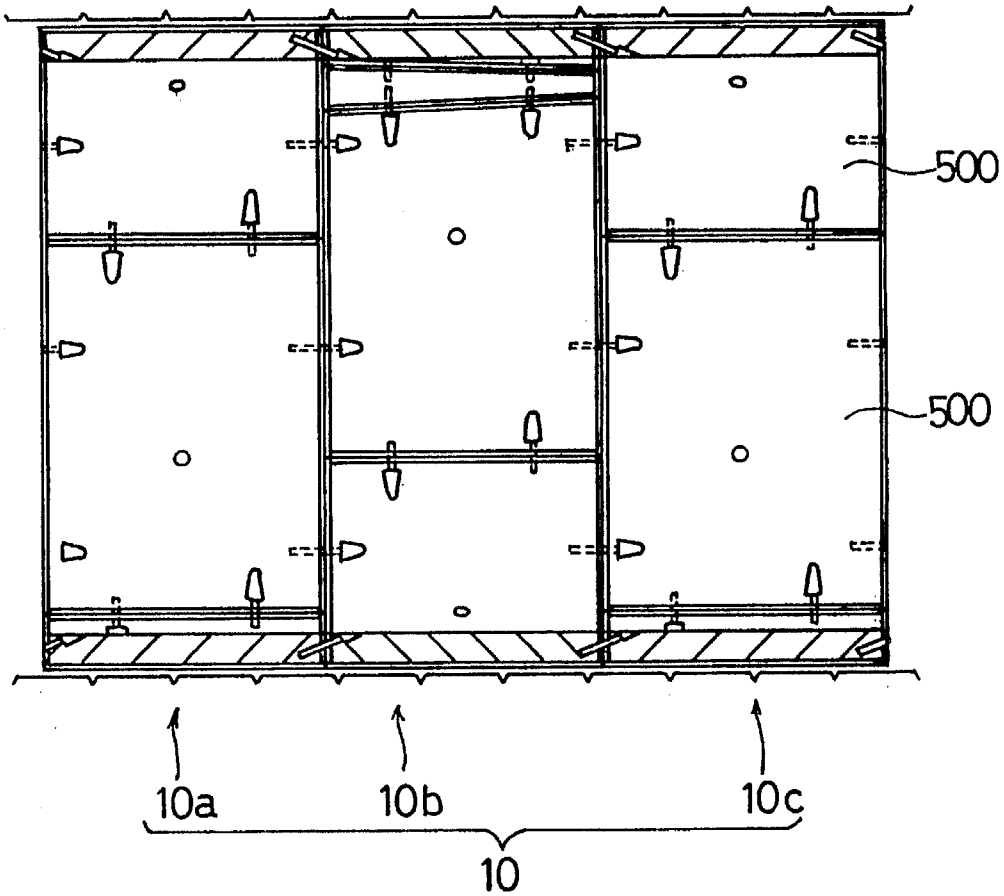
FIG. 36(*a*) and 36 (*b*) are views showing the assembling state of the tunnel liner of FIG. 35, wherein FIG. 36(*a*) is a front view.
Figure 36A:
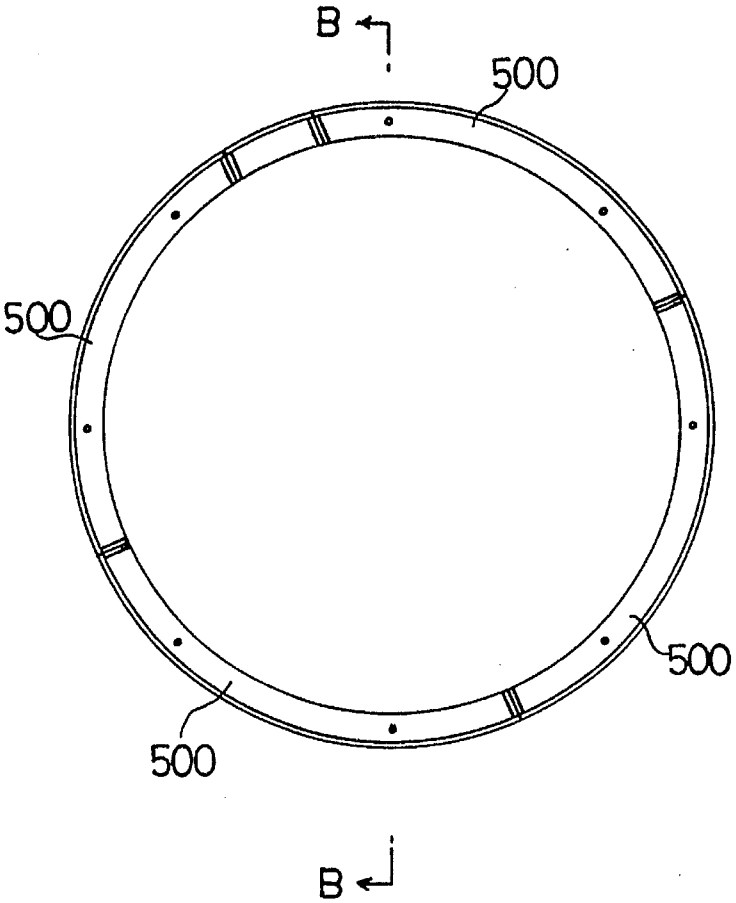

FIG. 35 is a typical vertical sectional view of a composite tunnel liner of the present invention. A box, which is formed of a steel or FRP made arcuate bottom plate 502, and side walls 506 erected around four peripheries and having a height equivalent to the thickness of the liner, is filled with a concrete 504, to be thus integrated with the concrete. FIG. 36 shows the usage state of such tunnel liner, wherein a plurality of liners 500 are cylindrically coupled with each other. FIG. 36(*a*) is a front view of the tunnel liner, wherein five liners 500 are coupled with each other in a cylindrical shape; and FIG. 36(*b*) is a vertical sectional view of FIG. 36(*a*) showing the state that three rings 10*a*, 10*b* and 10*c* are coupled to each other.

Figure 37:
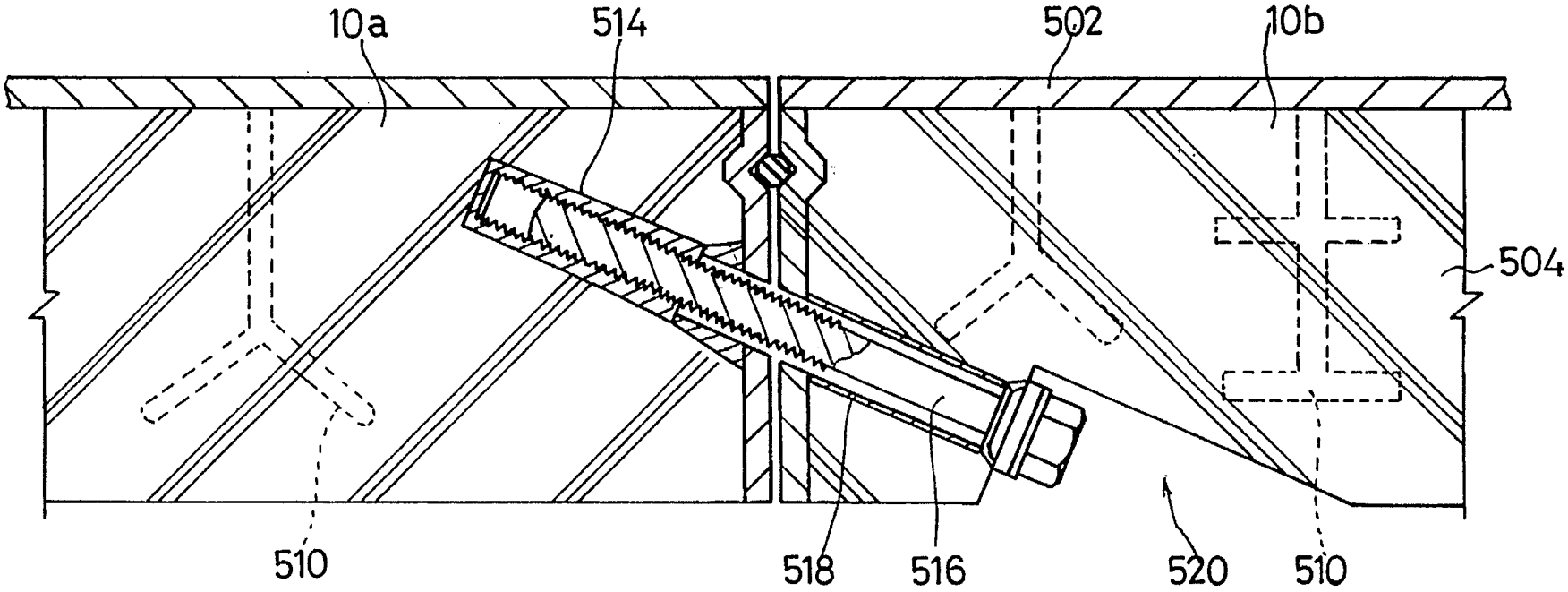
FIG. 37 is a sectional view showing the structure of the coupling structure of the tunnel liner of the embodiment.

FIG. 37 shows the structure of the coupling portion between the adjacent rings 10*a* and 10*b* in the composite tunnel liner. The circumferential coupling portion between the rings is of the same coupling system. The state that the concrete 504 is removed from FIG. 37 is the same as that in assembling of the form prior to the concrete placing. Namely, a plurality of doweled reinforcements 510 are mounted to the bottom plate 502; inserts 514 are mounted on the side walls 506 through mounting fixtures; sheaths 518 are mounted on the adjacent side walls 506 in correspondence with the above inserts 514; and the bolts 516 are screwed with the inserts 514 through the sheaths 518. Thus, the adjacent steel made boxes are coupled. A partial form for forming a notch 520 of concrete is provided on the head portion of the bolt 516, so that the bolt 516 can be removed. The partial form for forming the notch 520 may be fixed on the bolt 516 or bottom plate 502.

After concrete placing, the bolts 516 are removed, and the product is removed from the centrifugal molding drum. When the product is assembled at job side, as shown in FIG. 37, it is assembled in the same manner as in the fabrication, and can be coupled using the same bolts.

What is claimed is:

1. A method of fabricating centrifugally molded concrete tunnel liner segments comprising the steps of:

preparing individual arcuate hollow forms, each of which comprise an arcuate bottom plate, two arcuate side wall plates, two rectangular side wall plates, a removable arcuate cover plate and a charge opening near one of said rectangular side wall plates;

holding each of said arcuate hollow forms in a position such that said charge opening of each hollow form is in an upper position, so that three of four abutment portions of concrete being molded in said arcuate hollow form are adhered closely to inside surfaces of said hollow form;

filling each of said hollow forms with said concrete through said charge opening of said hollow form;

enclosing said charge opening of each said hollow forms;

accelerating flowing-down filling of said concrete and compacting said concrete by applying vibration to said concrete in each of said hollow forms, in order to fabricate at least one of projections and recessed grooves on surfaces of each abutment portion of each concrete tunnel liner segment being formed in each hollow arcuate form;

mounting a plurality of said concrete-filled, arcuate hollow forms in a centrifugal molding drum;

rotating said drum at high revolutions to consolidate said concrete by applying a centrifugal force to said concrete;

removing said arcuate hollow forms from said centrifugal molding drum, and also removing said removable arcuate cover plate of each of said arcuate hollow forms to allow for finishing of an arcuate inner surface side of said concrete tunnel liner segments formed in each of said arcuate hollow forms; and performing concrete curing.

2. A method of fabricating centrifugally molded concrete tunnel liner segments according to claim 1, wherein each of said hollow forms is mounted in said centrifugal molding drum such that one rectangular side wall plate of said hollow form on a side of said concrete charge opening is positioned on an upstream side of a rotational direction of said centrifugal molding drum, whereby concrete on an abutment surface on said concrete charge opening side is consolidated due to an inertial force during a revolutional acceleration period of said centrifugal molding drum.

3. A method of fabricating centrifugally molded concrete tunnel liner segments according to claim 1 further comprising reversing a rotational direction of said centrifugal molding drum.

4. A method of fabricating centrifugally molded tunnel liner segments of a concrete tunnel liner comprising:

mounting arcuate shaped forms of individual tunnel liner segments, which have an outside surface curvature radius larger than an inside surface radius curvature of a centrifugal molding drum, within a centrifugal molding drum;

placing concrete within said forms for centrifugal molding;

compacting said concrete centrifugally during rotation of said molding drum to obtain compacted concrete in each of said forms with an outside shape that follows an inside shape of each of said forms and an inside shape which is fabricated generally coaxially to a rotating center of said drum thus producing said individual tunnel liner segments;

removing said forms from said centrifugal molding drum; and removing excess concrete from an inside diameter side of said individual tunnel liner segments to provide said concrete with a substantially equal thickness, in order to manufacture larger diameter sized concrete tunnel liner segment employing said centrifugal drum having a smaller diameter than said concrete tunnel liner.

5. A method of fabricating accurate tunnel liner segments used to form tunnel liners comprising the steps of:

preparing a plurality of individual arcuate enclosed hollow forms to centrifugally formulate at least one of consolidated precise projections and recessed grooves on a surface of peripheral edges of each arcuate tunnel liner segment been formed in each arcuate enclosed hollow form;

holding each form such that arcuate side plates are in a vertical orientation;

filling the forms with concrete;

compacting the concrete with vibration;

removably mounting the individual arcuate enclosed hollow forms filled with the compacted concrete for forming a plurality of the arcuate tunnel liner segments within a centrifugal molding drum rotatable around a vertical center axis; and rotating and centrifugally molding each arcuate tunnel liner segment in each individual arcuate enclosed hollow form within the centrifugal molding drum.

* * * * *